US010037009B2

(12) United States Patent
Mugishima et al.

(10) Patent No.: US 10,037,009 B2
(45) Date of Patent: Jul. 31, 2018

(54) MOVEMENT AND ELECTRONIC TIMEPIECE

(71) Applicant: SEIKO INSTRUMENTS INC., Chiba-shi, Chiba (JP)

(72) Inventors: Katsuya Mugishima, Chiba (JP); Satoshi Sakai, Chiba (JP); Kenji Ogasawara, Chiba (JP); Tomohiro Ihashi, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 165 days.

(21) Appl. No.: 15/237,881

(22) Filed: Aug. 16, 2016

(65) Prior Publication Data

US 2017/0052510 A1 Feb. 23, 2017

(30) Foreign Application Priority Data

Aug. 21, 2015 (JP) ..... 2015-163993

(51) Int. Cl.
*G04C 3/14* (2006.01)

(52) U.S. Cl.
CPC ..... *G04C 3/146* (2013.01); *G04C 3/14* (2013.01)

(58) Field of Classification Search
CPC ..... G04C 3/14; G04C 3/143; G04C 3/146; G04C 10/02
See application file for complete search history.

(56) References Cited

U.S. PATENT DOCUMENTS 7,858,952 B2 * 12/2010 Feist ..... C23C 4/12 250/459.1
8,023,364 B2 * 9/2011 Kojima ..... G04C 3/14 368/11
8,208,348 B2 * 6/2012 Kojima ..... G04C 3/146 368/185
8,467,274 B2 * 6/2013 Aoki ..... G04R 60/14 368/187
8,929,179 B2 * 1/2015 Matsuo ..... G04G 9/00 368/187

(Continued)

FOREIGN PATENT DOCUMENTS

JP 2010-217015 * 9/2010

OTHER PUBLICATIONS

Abstract, Publication No. JP 2010-217015, Publication date Sep. 30, 2010.

*Primary Examiner* — Sean Kayes
(74) *Attorney, Agent, or Firm* — Adams & Wilks

(57) ABSTRACT

A power saving movement includes a center wheel and pinion driving a minute hand and minute detection wheel. A gear ratio of the center wheel/pinion with respect to the minute detection wheel is 1/M. The minute detection wheel has N minute detection portions which are disposed on the same rotation trajectory as the center wheel & pinion. N and M are integers. The minute detection wheel transmittable portions are disposed at an interval of 360°/N. A pair of the center wheel transmittable portions are disposed in parallel at an unequal angular interval of a center axle of the center wheel & pinion. An angular interval of the center wheel transmittable portions adjacent to each other in the circumferential direction of the center axle of the center wheel & pinion is set to magnification of 360°/(M×N).

5 Claims, 14 Drawing Sheets

(56) References Cited

U.S. PATENT DOCUMENTS

| | | | | |
|---|---|---|---|---|
| 2009/0086580 | A1* | 4/2009 | Aoki | G04C 3/14 368/10 |
| 2009/0161120 | A1* | 6/2009 | Kojima | G04C 3/14 356/615 |
| 2009/0296534 | A1* | 12/2009 | Kojima | G04C 3/14 368/185 |

* cited by examiner

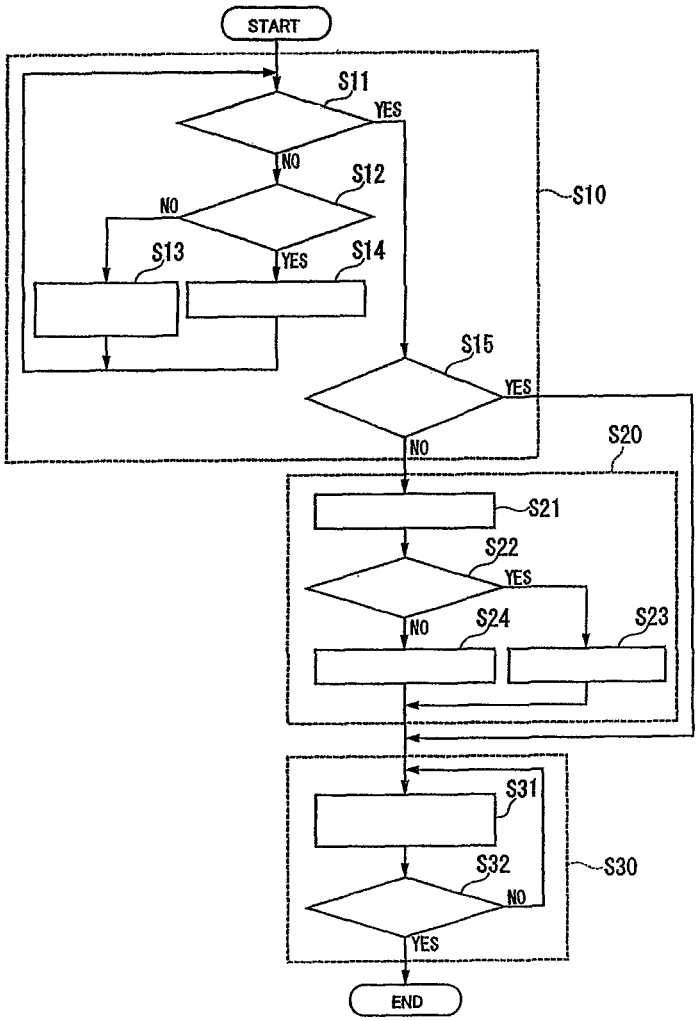

S11 DOES FIRST LIGHT RECEIVING ELEMENT RECEIVE LIGHT?
S12 IS CENTER WHEEL DRIVEN AS MUCH AS θ?
S13 DRIVE CENTER WHEEL ONE STEP
S14 DRIVE SECOND WHEEL AS MUCH AS β
S15 IS CENTER WHEEL DRIVEN AS MUCH AS 360° − θ OR LARGER?
S21 DRIVE CENTER WHEEL AS MUCH AS 360° − θ
S22 DOES FIRST LIGHT RECEIVING ELEMENT RECEIVE LIGHT?
S24 DRIVE CENTER WHEEL AS MUCH AS 360° − θ
S23 DRIVE CENTER WHEEL AS MUCH AS θ
S31 DRIVE SECOND WHEEL ONE STEP
S32 IS DESIRABLE PATTERN DETECTED?

FIG.12

21 FIRST STEPPING MOTOR
61 FIRST LIGHT EMITTING ELEMENT
64 FIRST LIGHT RECEIVING ELEMENT
18 (16)LIGHT EMITTING CONTROL UNIT
19 (16)DETECTION CONTROL UNIT
17 (16)ROTATION CONTROL UNIT
63 SECOND LIGHT EMITTING ELEMENT
66 SECOND LIGHT RECEIVING ELEMENT
23 SECOND STEPPING MOTOR

ROTATION ANGLE [deg] 0 360 720 ...
MINUTE DETECTION WHEEL
ON
OFF
ROTATION ANGLE [deg] 0 12 24 36 48 60 72 84 96 108 120 132 144 156 168 180 192 204 216 228 240 252 264 276 288 300 312 324 336 348 360 372 384 396 408 420 432 444 456 468 480
CENTER WHEEL
ON
OFF
SECOND WHEEL
ON
OFF
DETECTION DETERMINATION
0 0 0

CENTER WHEEL
ON
OFF
ROTATION AMOUNT
0 6 12 18 24 30 36 42 48 54 60 66 72 78 84 90 96 102 108 114 120 126 132 138 144 150 156 162 168 174 180 186 192 198 204 210 216 222 228 234 240 246 252 258 264 270 276 282 288 294 300 306 312 318 324 330 336 342 348 354 360
SECOND WHEEL
ON
OFF
DETECTION DETERMINATION
0 0 0 0 0 0 0 1 1 1 1 1 1 1 1 1 1 1 1 1 1 0 0 0 0 0 0 0 0 0 0 0 0 0 0 0 0 0 0 0 0 1 1 1 1 1 1 1 1 1 1 1 1 1 1

S11 DOES FIRST LIGHT RECEIVING ELEMENT RECEIVE LIGHT?
S120 IS CENTER WHEEL DRIVEN AS MUCH AS $\theta 1$?
S13 DRIVE CENTER WHEEL ONE STEP
S14 DRIVE SECOND WHEEL AS MUCH AS $\beta$ 21 FIRST STEPPING MOTOR
61 FIRST LIGHT EMITTING ELEMENT
64 FIRST LIGHT RECEIVING ELEMENT
18 (16)LIGHT EMITTING CONTROL UNIT
19 (16)DETECTION CONTROL UNIT
17 (16)ROTATION CONTROL UNIT
63 SECOND LIGHT EMITTING ELEMENT
66 SECOND LIGHT RECEIVING ELEMENT
23 SECOND STEPPING MOTOR

MOVEMENT AND ELECTRONIC TIMEPIECE

BACKGROUND OF THE INVENTION

Field of the Invention

The present invention relates to a movement and an electronic timepiece.

Background Art

In the related art, an electronic timepiece such as a radio timepiece provided with an automatic correction function of a hand position is known.

For example, Japanese Patent No. 5267244 discloses an electronic timepiece. In the electronic timepiece, a first train wheel includes one or more first train wheel detection gears having a detection hole through which detection light output from a light emitting element is transmittable. A second train wheel includes a detection light transmitting gear arranged coaxially with any one of the first train wheel detection gears in the first train wheel. In the detection light transmitting gear, a long hole through which the detection light is transmittable and a light-blocking portion for blocking the detection light are formed at a position overlapping a rotation trajectory of the detection hole of the first train wheel detection gear.

According to the electronic timepiece disclosed in Japanese Patent No. 5267244, it is possible to coaxially arrange multiple indicating hands driven by different motors and train wheels. Even if the electronic timepiece does not include a hand position detection mechanism of the other side indicating hand, the electronic timepiece can reliably and quickly detect a hand position of one side indicating hand.

According to the electronic timepiece in the related art, in order to detect the detection hole, the first train wheel detection gear needs to be rotated once to the maximum in a state where the long hole is arranged at a position corresponding to an optical sensor.

SUMMARY OF THE INVENTION

Incidentally, for example, an electronic timepiece including a solar panel has a limited power amount stored in a secondary battery. Accordingly, in order to further lengthen an operating time period of the electronic timepiece, an effective way is to further reduce power consumption. Therefore, the above-described electronic timepiece in the related art needs to reduce the power consumption when a hand position is detected.

Therefore, the invention aims to provide a movement and an electronic timepiece which can reduce power consumption when a hand position is detected.

According to an aspect of the invention, there is provided a movement including a first gear that is rotated by power of a first drive source so as to drive a first indicating hand, a position detecting gear that is rotated by the power of the first drive source, and in which a gear ratio of the first gear with respect to the position detecting gear is set to 1/M by using M as an integer, a light emitting element that is arranged on one side in an axial direction of a center axle of the first gear, with respect to the first gear and the position detecting gear, and a light receiving element that is arranged on the other side in the axial direction across the first gear and the position detecting gear, and that detects light emitted from the light emitting element. The first gear has multiple first transmittable portions which are disposed on the same rotation trajectory, and through which the light emitted from the light emitting element is transmittable. The position detecting gear has the N-number of second transmittable portions which are disposed on the same rotation trajectory, and through which the light emitted from the light emitting element is transmittable. The second transmittable portions are disposed at an interval of 360°/N in a circumferential direction of the position detecting gear. The multiple first transmittable portions are disposed in parallel at an unequal angular interval in the circumferential direction of the center axle. An angular interval of the first transmittable portions adjacent to each other in the circumferential direction of the center axle is set to magnification of 360°/(M×N).

In the aspect, the multiple first transmittable portions are disposed in parallel at the unequal angular interval in the circumferential direction. Accordingly, a rotation position of the first gear can be determined by detecting a circumferential distance between the first transmittable portions adjacent to each other in the circumferential direction. In this case, while the first gear is rotated, the light receiving element is caused to detect the light emitted from the light emitting element and transmitted through the first transmittable portions so as to determine a rotation amount of the first gear and the presence or absence of the first transmittable portions. In this manner, it is possible to detect the circumferential distance between the first transmittable portions. Accordingly, compared to a configuration in which one first transmittable portion is disposed in the first gear, it is possible to minimize the rotation amount of the first gear, when the rotation position of the first gear is determined in response to the position detection of the first indicating hand. Therefore, it is possible to shorten a time for operating the light emitting element, and thus, it is possible to reduce power consumption when the hand position is detected.

In the aspect, in the position detecting gear, the gear ratio of the first gear with respect to the position detecting gear is set to 1/M, and the second transmittable portions are disposed on the same rotation trajectory at the interval of 360°/N. Accordingly, if the first gear and the position detecting gear are concurrently rotated by driving the first drive source, whenever the second transmittable portion is brought into a state of being located at a position corresponding to a portion between the light emitting element and the light receiving element (hereinafter, referred to as a "detection position"), the first gear is rotated as much as 360°/(M×N). The angular interval of the first transmittable portions adjacent to each other in the circumferential direction of the center axle is set to the magnification of 360°/(M×N). Accordingly, the first gear and the position detecting gear are disposed for the first drive source so that the second transmittable portion is located at the detection position in a state where any one of the first transmittable portions is located at the detection position. In this manner, when the respective first transmittable portions are located at the detection position, the second transmittable portion can be concurrently located at the detection position.

Furthermore, in the position detecting gear, the gear ratio of the first gear with respect to the position detecting gear is set to 1/M. Accordingly, the rotation angle of the position detecting gear with respect to the first drive source becomes larger than the rotation angle of the first gear. In this manner, the second transmittable portion can be caused to retreat from the detection position earlier than the first transmittable portion, in a state where the first transmittable portion and the second transmittable portion are located at the detection position and the light emitted from the light emitting element can be transmitted to the light receiving element.

Accordingly, even in a case where the rotation angle of the first gear for one step driving of the first drive source is small, one step of the first drive source enables the light receiving element to be shifted between a state where the light emitted from the light emitting element can be detected and a state where the light cannot be detected.

Through the above-described processes, it is possible to reliably detect the rotation position of the first gear in response to the position detection of the first indicating hand, and it is possible to reduce power consumption when the hand position is detected.

In the aspect, the movement may further include a second gear that is arranged coaxially with the center axle, and that is rotated by power of a second drive source so as to drive a second indicating hand, and a control unit that controls driving of the first drive source and the second drive source, and that detects the light received by the light receiving element. The second gear may have a third transmittable portion which is disposed on a rotation trajectory of the first transmittable portion when viewed in the axial direction, and through which the light emitted from the light emitting element is transmittable. The third transmittable portion may be a long hole extending in a circumferential direction of the center axle. A first central angle formed by both end portions of the third transmittable portion may be set to be equal to or larger than a second central angle corresponding to a portion between the end portions of the third transmittable portion corresponding to a region other than the third transmittable portion of the second gear. In a central angle formed by the first transmittable portions adjacent to each other in the circumferential direction, the maximum central angle may be set to θ. The control unit may perform a transmitted state determination step of determining whether or not the light receiving element receives the light emitted from the light emitting element, a rotation angle determination step of determining whether or not the rotation angle of the first gear is equal to or larger than θ, in a case where the light receiving element does not receive the light emitted from the light emitting element in the transmitted state determination step, a first drive step of performing the transmitted state determination step again by driving the first drive source and rotating the first gear, in a case where the control unit determines that the rotation angle of the first gear is smaller than θ, in the rotation angle determination step, and a second drive step of performing the transmitted state determination step again by driving the second drive source and rotating the second gear as much as a predetermined angle, in a case where the control unit determines that the rotation angle of the first gear is equal to or larger than θ, in the rotation angle determination step. The predetermined angle may be equal to or larger than the second central angle, and may be equal to or smaller than the first central angle.

In the aspect, the third transmittable portion is disposed on the rotation trajectory of the first transmittable portion when viewed in the axial direction. Accordingly, in a case where the first transmittable portion, the second transmittable portion, and the third transmittable portion are located at the detection position, the light receiving element detects the light emitted from the light emitting element.

The first gear is rotated to the maximum as much as θ by repeatedly performing the transmitted state determination step, the rotation angle determination step, and the first drive step. Accordingly, the first transmittable portion passes through the detection position at least once. In this manner, it is possible to determine whether or not the third transmittable portion is located at the detection position.

Next, in a case where a region other than the third transmittable portion of the second gear (hereinafter, referred to as a "light-blocking region") is located at the detection position, in the second drive step, the second gear is rotated as much as the predetermined angle which is equal to or larger than the second central angle corresponding to a portion between the end portions of the third transmittable portion corresponding to the light-blocking region, and which is equal to or smaller than the first central angle formed by both end portions of the third transmittable portion. In this manner, the light-blocking region can be caused to retreat from the detection position, and the third transmittable portion can be moved to the detection position.

Through the above-described processes, it is possible to more quickly determine whether or not the third transmittable portion is located at the detection position, compared to a configuration in which the determination is made by rotating the first gear as much as 360° as in the related art. In addition, in a case where the light-blocking region is located at the detection position, the second drive step is performed once. In this manner, it is not necessary to determine again whether or not the third transmittable portion is located at the detection position, and it is possible to minimize the rotation amount of the first gear in determining the rotation position of the first gear. Therefore, it is possible to shorten a time for operating the light emitting element, and thus, it is possible to reduce power consumption when the hand position is detected.

In the movement, the first indicating hand may be a minute hand.

In the aspect, it is possible to reduce power consumption when the position of the minute hand is detected.

According to another aspect of the invention, there is provided an electronic timepiece including the movement and a solar panel that generates power to be supplied to the first drive source.

In the aspect, since the movement is provided, it is possible to reduce power consumption when the hand position is detected. Therefore, the invention is preferably applicable to the electronic timepiece including the solar panel.

According to an aspect of the invention, it is possible to reduce power consumption when the hand position is detected.

BRIEF DESCRIPTION OF THE DRAWINGS

FIG. 12 is a flowchart illustrating a hand position detection operation according to the first embodiment.

DETAILED DESCRIPTION OF THE INVENTION

Hereinafter, a first embodiment according to the invention will be described with reference to the drawings.

First Embodiment

First, the first embodiment will be described.

In general, a mechanical body including a drive portion of a timepiece is called a "movement". The timepiece in a finished state where the movement is accommodated in a timepiece case by attaching a dial and indicating hands to the movement is referred to as a "complete assembly".

A side having glass of the timepiece case in both sides of a main plate configuring a substrate of the timepiece, that is, a side having a dial is referred to as a "rear side". In addition, a side having a case rear cover of the timepiece case in both sides of the main plate, that is, a side opposite to the dial is referred to as a "front side".

Electronic Timepiece

Figure 1:
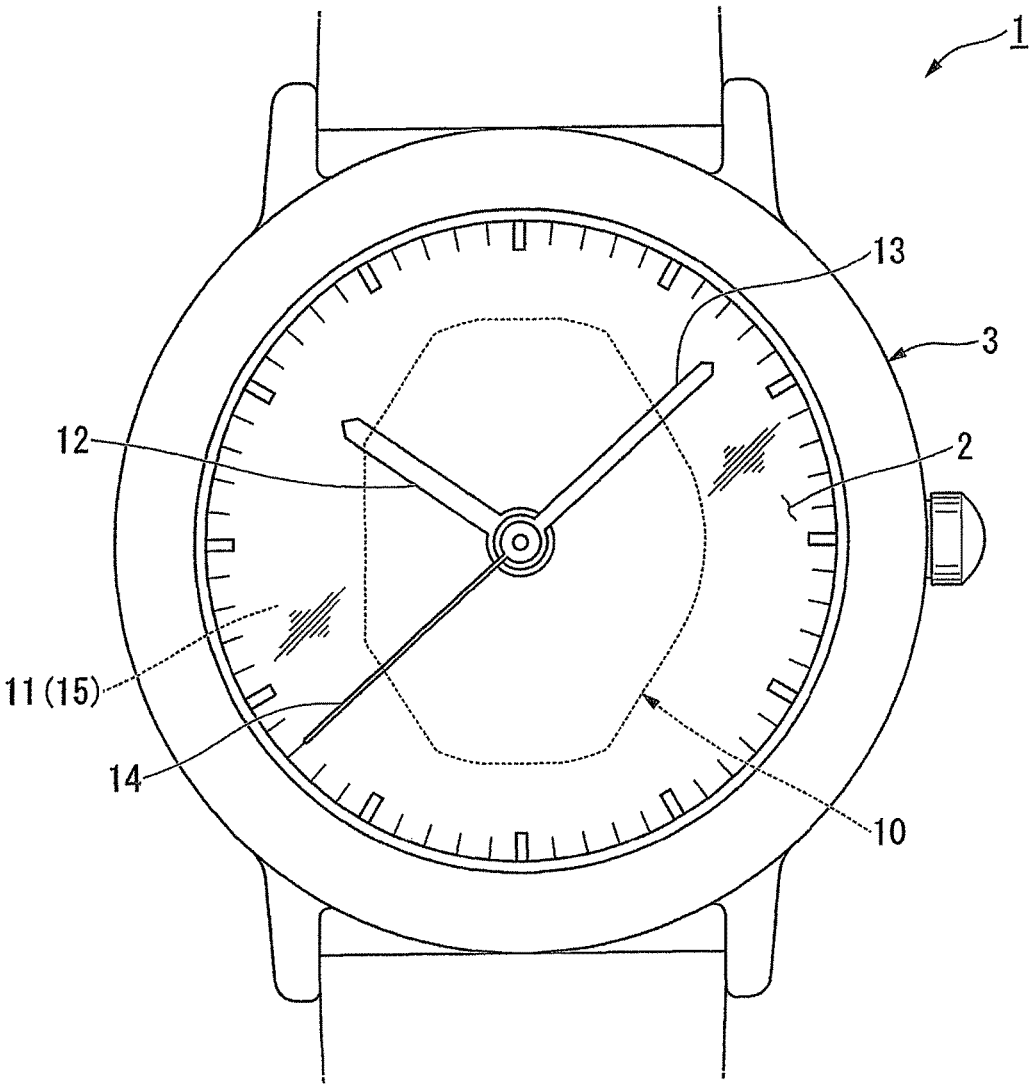
FIG. 1 is an external view illustrating an electronic timepiece according to an embodiment.

FIG. 1 is an external view of an electric timepiece according to an embodiment.

As illustrated in FIG. 1, an electronic timepiece 1 according to the present embodiment is an analog timepiece. The complete assembly of the electronic timepiece 1 includes a movement 10, a dial 11, and indicating hands 12, 13, and 14 inside a timepiece case 3 having the case rear cover (not illustrated) and glass 2.

The dial 11 is formed integrally with a solar panel 15, and has a scale indicating information relating to at least the hour. The solar panel 15 generates power to be supplied to respective stepping motors 21, 22, and 23 (refer to FIG. 2) via a control unit 16 (refer to FIG. 3) (to be described later). The indicating hands 12, 13, and 14 include the hour hand 12 indicating the hour, the minute hand 13 (first indicating hand) indicating the minute, and the second hand 14 (second indicating hand) indicating the second. The dial 11, the hour hand 12, the minute hand 13, and the second hand 14 are arranged so as to be visible through the glass 2.

Movement

Figure 2:
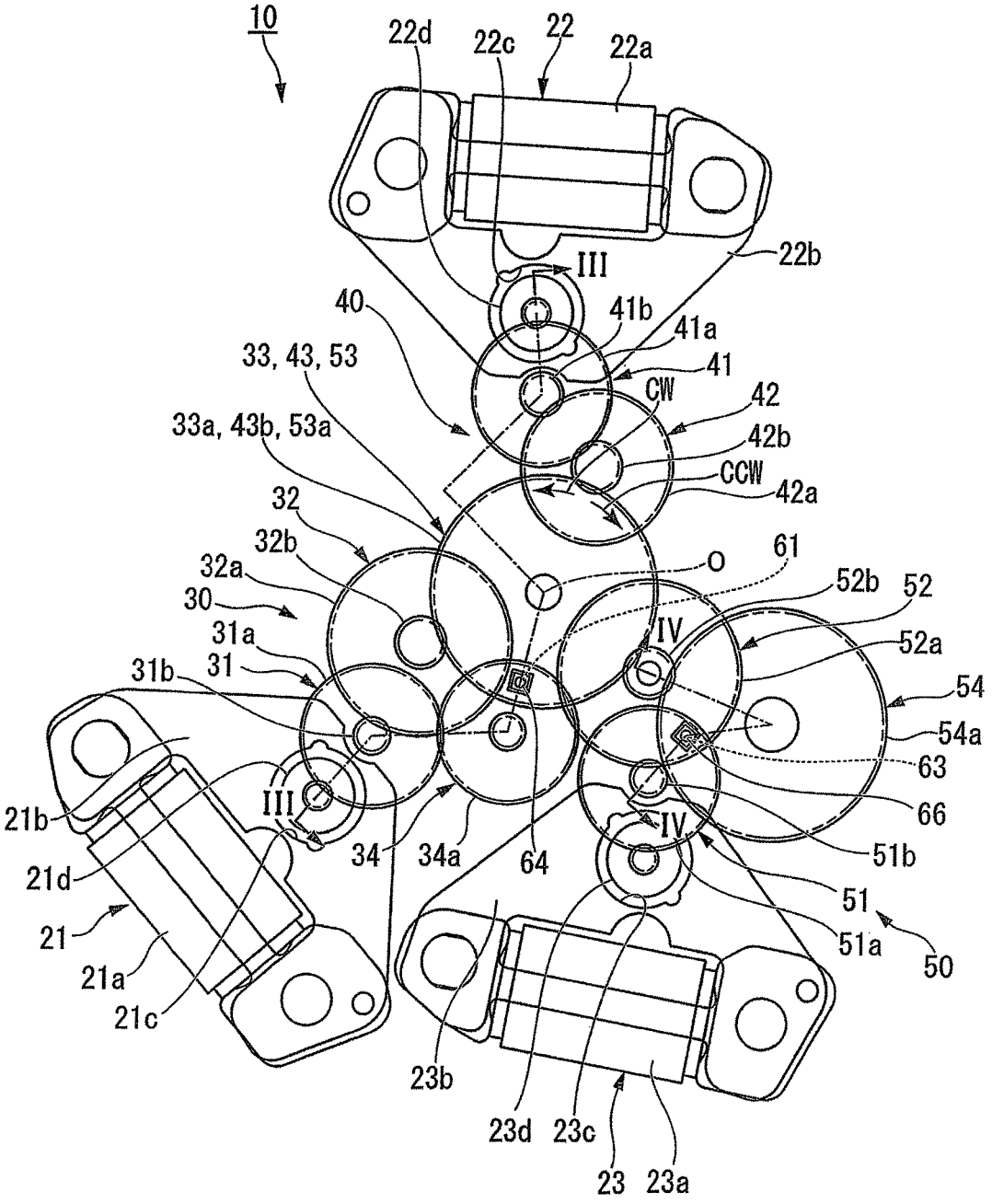
FIG. 2 is a plan view when a movement is viewed from a front side.
Figure 3:
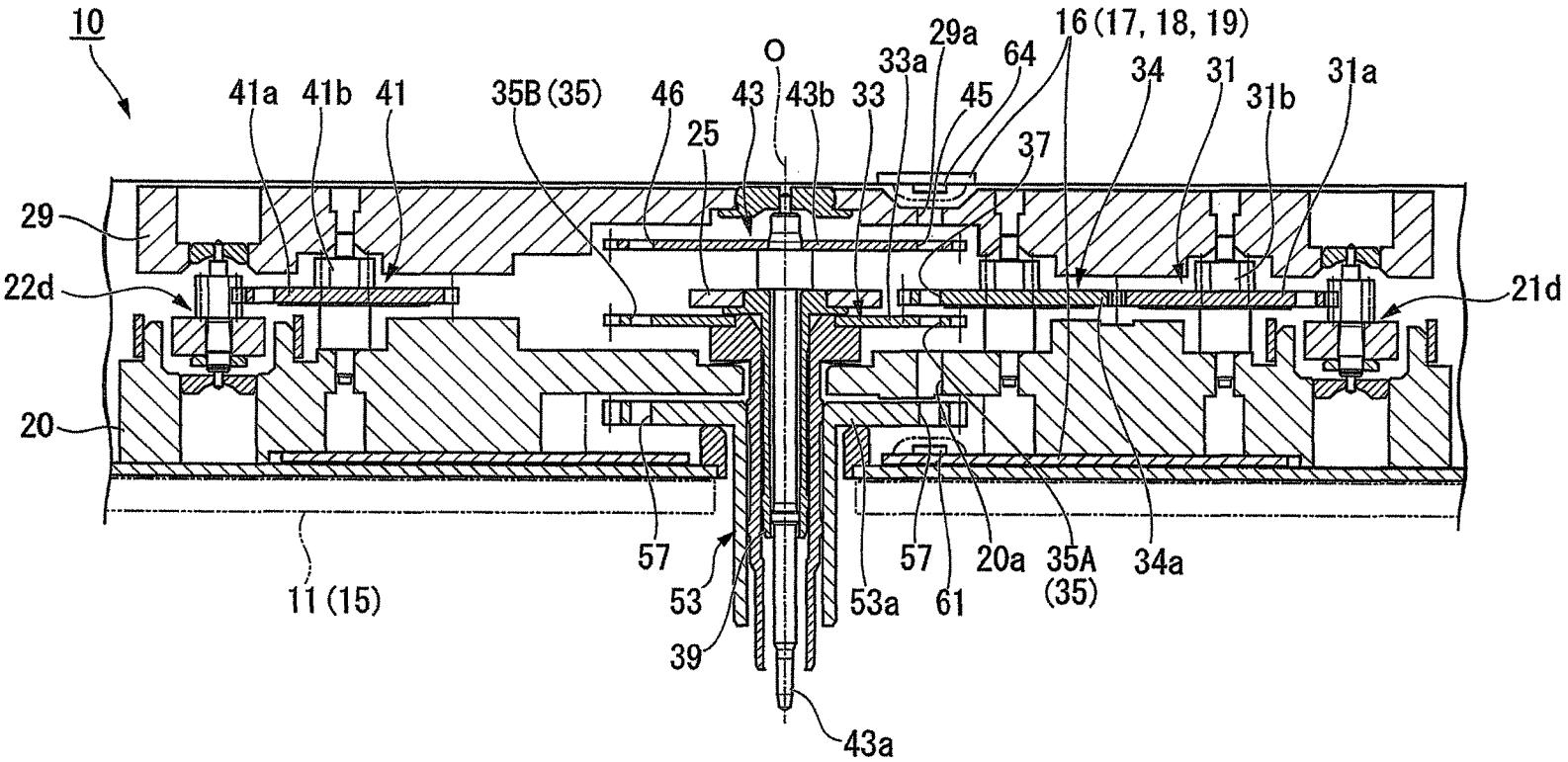
FIG. 3 is a sectional view taken along line III-III in FIG. 2.
Figure 4:
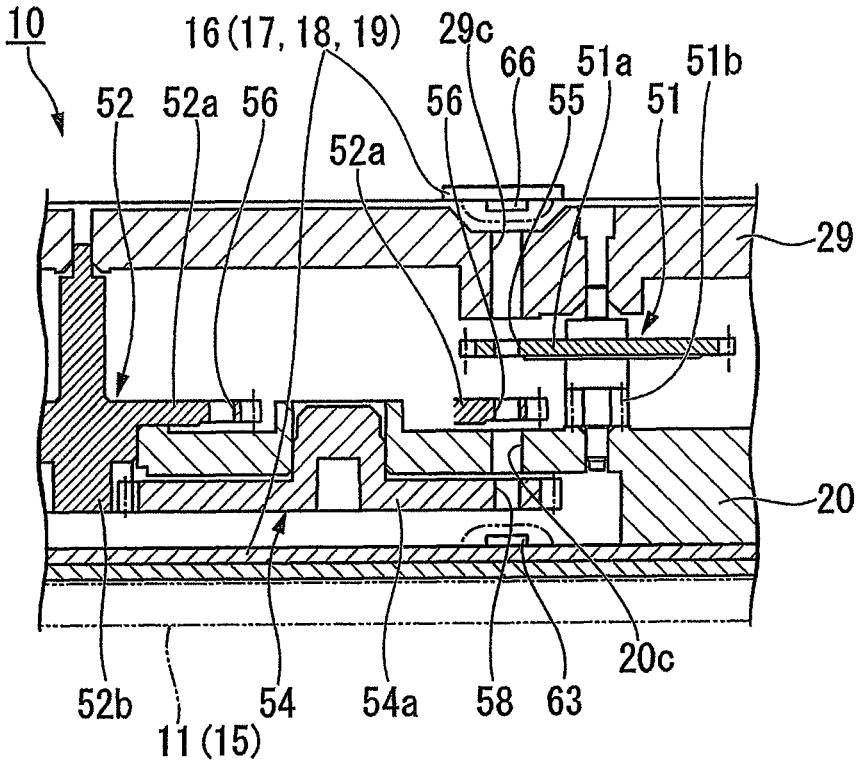
FIG. 4 is a sectional view taken along line IV-IV in FIG. 2.

FIG. 2 is a plan view when the movement is viewed from the front side. FIG. 3 is a sectional view taken along line III-III in FIG. 2. FIG. 4 is a sectional view taken along line IV-IV in FIG. 2.

As illustrated in FIGS. 2 to 4, the movement 10 mainly includes a secondary battery (not illustrated), the control unit 16, a main plate 20, a train wheel bridge 29, the first stepping motor 21 (first drive source), the second stepping motor 22 (second drive source), the third stepping motor 23, a first train wheel 30, a second train wheel 40, a third train wheel 50, a first light emitting element 61 (light emitting element), a second light emitting element 63, a first light receiving element 64 (light receiving element), and a second light receiving element 66.

The secondary battery (not illustrated) is charged with power supplied from the solar panel 15, and supplies the power to the control unit 16.

The control unit 16 is a circuit board, and has an integrated circuit mounted thereon. For example, the integrated circuit is configured to include C-MOS or PLA. The control unit 16 includes a rotation control unit 17 for controlling the respective stepping motors 21, 22, and 23, a light emitting control unit 18 for controlling the respective light emitting elements 61 and 63, and a detection control unit 19 for detecting light received by the respective light receiving elements 64 and 66.

The main plate 20 configures the substrate of the movement 10. The dial 11 is arranged on the rear side of the main plate 20.

The train wheel bridge 29 is arranged on the front side of the main plate 20.

As illustrated in FIG. 2, the respective stepping motors 21, 22, and 23 have coil blocks 21*a*, 22*a*, and 23*a* including a coil wire wound around a magnetic core, stators 21*b*, 22*b*, and 23*b* arranged so as to come into contact with both end portions of the magnetic core of the coil blocks 21*a*, 22*a*, and 23*a*, and rotors 21*d*, 22*d*, and 23*d* arranged in rotor holes 21*c*, 22*c*, and 23*c* of the stators 21*b*, 22*b*, and 23*b*. As illustrated in FIGS. 3 and 4, the respective rotors 21*d*, 22*d*, and 23*d* are rotatably supported by the main plate 20 and the train wheel bridge 29. The respective stepping motors 21, 22, and 23 are connected to the rotation control unit 17.

As illustrated in FIG. 2, the first train wheel 30 has a center wheel & pinion 33 (the first gear) which is rotated by the power of the first stepping motor 21 so as to drive the minute hand 13, a first center intermediate wheel 31 and a second center intermediate wheel 32 which transmit the power of the first stepping motor 21 to the center wheel & pinion 33, and a minute detection wheel 34 (position detecting gear) which is rotated by the power of the first stepping motor 21. A gear ratio of the center wheel & pinion 33 with respect to the minute detection wheel 34 is set to 1/M (M is 30 in the present embodiment) by using M as an integer.

The first center intermediate wheel 31 has a first center intermediate gear 31*a* and a first center intermediate pinion 31*b*, and is rotatably supported by the main plate 20 and the train wheel bridge 29 (refer to FIG. 3). The first center intermediate gear 31*a* meshes with a pinion of the rotor 21*d* of the first stepping motor 21.

The second center intermediate wheel 32 has a second center intermediate gear 32*a* and a second center intermediate pinion 32*b*, and is rotatably supported by the main plate 20 and the train wheel bridge 29. The second center intermediate gear 32*a* meshes with the first center intermediate pinion 31*b* of the first center intermediate wheel 31.

As illustrated in FIG. 3, the center wheel & pinion 33 is externally and rotatably inserted into a central pipe 39. The central pipe 39 is held in a central wheel bridge 25 fixed to the main plate 20. In the following description, the extending direction of the center axle O of the center wheel & pinion 33 is referred to as the axial direction, the train wheel bridge 29 side (front side) along the axial direction is referred to as an upper side, and the main plate 20 side (rear side) is referred to as a lower side. In addition, as illustrated in FIG. 2, an arrow CW in the drawing indicates a direction turning clockwise around the center axle O when the movement 10 is viewed from below, and an arrow CCW indicates a direction turning counterclockwise around the center axle O when the movement 10 is viewed from below.

As illustrated in FIG. 2, the center wheel & pinion 33 has a center gear 33*a* which meshes with the second center intermediate pinion 32*b* of the second center intermediate wheel 32. For example, the center wheel & pinion 33 is configured to be rotated once if the first stepping motor 21 is rotated 360 steps. The rotation angle of the center wheel & pinion 33 which corresponds to one step of the first stepping motor 21 is set to 1°. The minute hand 13 is attached to a lower end portion of the center wheel & pinion 33.

Figure 5:
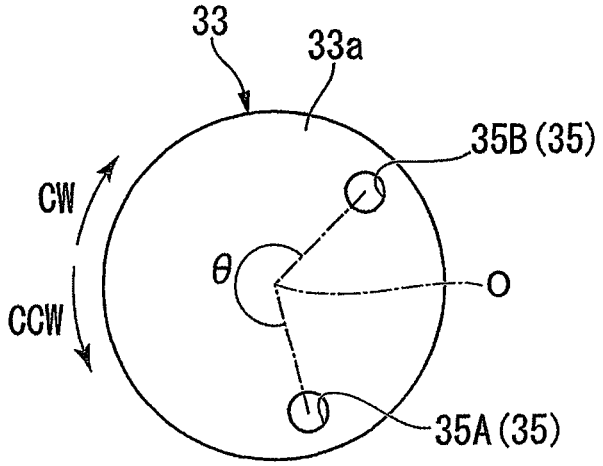
FIG. 5 is a plan view of a center wheel & pinion according to a first embodiment.

FIG. 5 is a plan view of the center wheel & pinion according to the first embodiment.

As illustrated in FIG. 5, the center wheel & pinion 33 has a pair of center wheel transmittable portions 35 (first transmittable portion) which are disposed on the same rotation trajectory and through which the light is transmittable. The term of "rotation trajectory" described herein represents a region R through which the center wheel transmittable portion 35 passes when the center wheel & pinion 33 is rotated (similar in the following description). A pair of the center wheel transmittable portions 35 are circular through-holes formed in the same shape, for example. A pair of the center wheel transmittable portions 35 are disposed in parallel at an unequal interval in the circumferential direction of the center axle O. An angular interval of the center wheel transmittable portions 35 is set to multiplication of 360°/(M×N) (multiplication of 12° in the present embodiment) by setting the number of the minute detection wheel transmittable portions 37 (refer to FIG. 6) of the minute detection wheel 34 (to be described later) to N (N=1 in the present embodiment). The maximum central angle θ in the central angle formed by a pair of the center wheel transmittable portions 35 is set to 240°, for example. A pair of the center wheel transmittable portions 35 have a first center wheel transmittable portion 35A and a second center wheel transmittable portion 35B disposed at a position where the second center wheel transmittable portion 35B is rotated from the first center wheel transmittable portion 35A as much as the angle θ in the direction CW.

Here, the center wheel transmittable portions 35 are disposed in a parallel state at the unequal angular interval in the circumferential direction. A state of the unequal angular interval represents a state where multiple intervals are present between the transmittable portions due the multiple center wheel transmittable portions and the multiple intervals are not equal. In the present embodiment, the interval from the first center wheel transmittable portion 35A to the second center wheel transmittable portion 35B when viewed in the direction CW is different from the interval from the second center wheel transmittable portion 35B to the first center wheel transmittable portion 35A when viewed in the direction CW. That is, if these intervals are combined, the combination corresponds to one circumferential round. If these intervals and the diameters of the transmittable portions are all combined, the angle becomes 360°. In other words, the multiple intervals are present between the transmittable portions, and the intervals have mutually different sizes. If the intervals are combined, the combination of the intervals has a size of one circumferential round corresponding to approximately 360°.

As illustrated in FIG. 3, the minute detection wheel 34 is rotatably supported by the main plate 20 and the train wheel bridge 29. As illustrated in FIG. 2, the minute detection wheel 34 is arranged so as to partially overlap the center wheel & pinion 33 when viewed in the axial direction. The minute detection wheel 34 has a minute detection gear 34*a*. The minute detection gear 34*a* meshes with the first center intermediate gear 31*a* of the first center intermediate wheel 31. For example, if the first stepping motor 21 is rotated 12 steps, the minute detection wheel 34 is configured to be rotated once. The rotation angle of the minute detection wheel 34 which corresponds to one step of the first stepping motor 21 is set to 30°.

Figure 6:
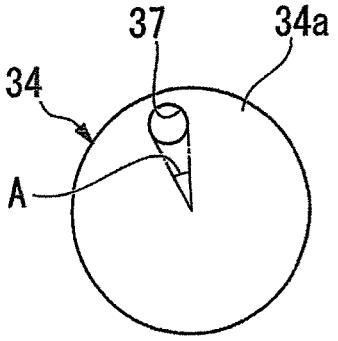
FIG. 6 is a plan view of a minute detection wheel according to the first embodiment.

FIG. 6 is a plan view of the minute detection wheel according to the first embodiment.

As illustrated in FIG. 6, the minute detection wheel 34 has the N-number (one in the present embodiment) of minute detection wheel transmittable portions 37 (second transmittable portions) through which the light is transmittable. The minute detection wheel transmittable portion 37 is a circular through-hole, for example. A central angle A corresponding to a portion between a pair of tangent lines passing through the rotation center of the minute detection wheel 34 in the tangent line of the minute detection wheel transmittable portion 37 in a plan view is set to be smaller than the rotation angle of the minute detection wheel 34 which corresponds to one step of the first stepping motor 21, for example.

As illustrated in FIG. 2, the second train wheel 40 has a second wheel & pinion 43 (second gear) which is rotated by the power of the second stepping motor 22 so as to drive the second hand 14, a sixth wheel 41 and a fifth wheel 42 which transmit the power of the second stepping motor 22 to the second wheel & pinion 43.

The sixth wheel 41 has a sixth gear 41*a* and a sixth wheel pinion 41*b*, and is rotatably supported by the main plate 20 and the train wheel bridge 29 (refer to FIG. 3). The sixth gear 41*a* meshes with a pinion of the rotor 22*d* of the second stepping motor 22.

The fifth wheel 42 has a fifth gear 42*a* and a fifth wheel pinion 42*b*, and is rotatably supported by the main plate 20 and the train wheel bridge 29. The fifth gear 42*a* meshes with the sixth wheel pinion 41*b* of the sixth wheel 41:

The second wheel & pinion 43 is arranged coaxially with the center axle O. As illustrated in FIG. 3, the second wheel & pinion 43 has a wheel axle 43*a* and a second gear 43*b* fixed to the wheel axle 43*a*. The wheel axle 43*a* is rotatably inserted into the central pipe 39. The second hand 14 is attached to a lower end portion of the wheel axle 43*a*. As illustrated in FIG. 2, the second gear 43*b* meshes with the fifth wheel pinion 42*b* of the fifth wheel 42. For example, if the second stepping motor 22 is rotated 60 steps, the second wheel & pinion 43 is configured to be rotated once. The rotation angle of the second wheel & pinion 43 which corresponds to one step of the second stepping motor 22 is set to 6°.

Figure 7:
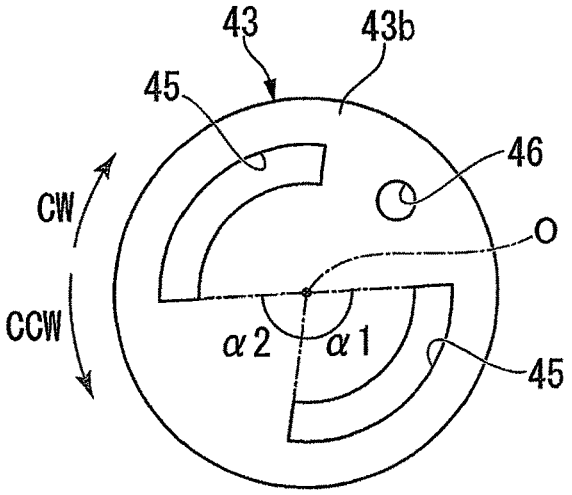
FIG. 7 is a plan view of a second wheel & pinion according to the first embodiment.

FIG. 7 is a plan view of the second wheel & pinion according to the first embodiment.

As illustrated in FIG. 7, the second wheel & pinion 43 has a pair of first second wheel transmittable portions 45 (third transmittable portion) through which the light is transmittable and a second second wheel transmittable portion 46 through which the light is transmittable.

A pair of the first second wheel transmittable portions 45 are disposed on the rotation trajectory of the center wheel transmittable portion 35 of the center wheel & pinion 33 when viewed in the axial direction. A pair of the first second wheel transmittable portions 45 respectively form long holes extending along the circumferential direction of the second wheel & pinion 43. A pair of the first second wheel transmittable portions 45 are symmetric with each other with respect to the center axle O. The dimension of the respective first second wheel transmittable portions 45 along the circumferential direction of the second wheel & pinion 43 is set to the dimension which is equal to or larger than the separated distance between end portions of a pair of the first second wheel transmittable portions 45 along the circumferential direction of the second wheel & pinion 43. A first central angle $\alpha 1$ formed by both end portions of the respective first second wheel transmittable portions 45 is set to be equal to or larger than a second central angle $\alpha 2$ corresponding to a portion between the end portions of the first second wheel transmittable portion 45 corresponding to a region other than the first second wheel transmittable portion 45 of the second wheel & pinion 43. In the present embodiment, the first central angle $\alpha 1$ is set to 100°. In addition, the second central angle $\alpha 2$ is set to 80°.

The second second wheel transmittable portion 46 is disposed on the rotation trajectory of the first second wheel transmittable portion 45. For example, the second second wheel transmittable portion 46 is a circular through-hole having the same inner diameter as the width dimension of the first second wheel transmittable portion 45. The second second wheel transmittable portion 46 is disposed on the rotation trajectory of the first second wheel transmittable portion 45, at an intermediate position between a pair of the first second wheel transmittable portions 45.

As illustrated in FIG. 2, the third train wheel 50 has an intermediate minute wheel 51, a minute wheel 52, an hour wheel 53, and an hour detection wheel 54.

The intermediate minute wheel 51 has an intermediate minute gear 51*a* and an intermediate minute wheel pinion 51*b*, and is rotatably supported by the main plate 20 and the train wheel bridge 29 (refer to FIG. 4). The intermediate minute gear 51*a* meshes with a pinion of the rotor 23*d* of the third stepping motor 23.

Figure 8:
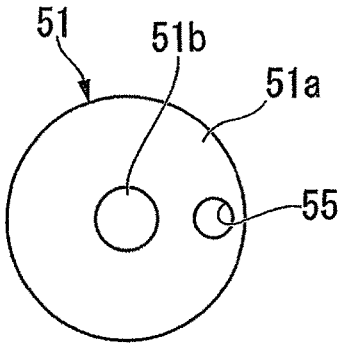
FIG. 8 is a plan view of an intermediate minute wheel according to the first embodiment.

FIG. 8 is a plan view of the intermediate minute wheel according to the first embodiment.

As illustrated in FIG. 8, the intermediate minute wheel 51 has an intermediate minute wheel transmittable portion 55 through which the light is transmittable. The intermediate minute wheel transmittable portion 55 is a circular through-hole.

As illustrated in FIG. 4, the minute wheel 52 is rotatably supported by the main plate 20 and the train wheel bridge 29. As illustrated in FIG. 2, the minute wheel 52 has a minute gear 52*a* and a minute wheel pinion 52*b*. The minute gear 52*a* meshes with the intermediate minute wheel pinion 51*b*. The minute gear 52*a* is arranged so as to overlap a portion of the intermediate minute gear 51*a* of the intermediate minute wheel 51 when viewed in the axial direction.

Figure 9:
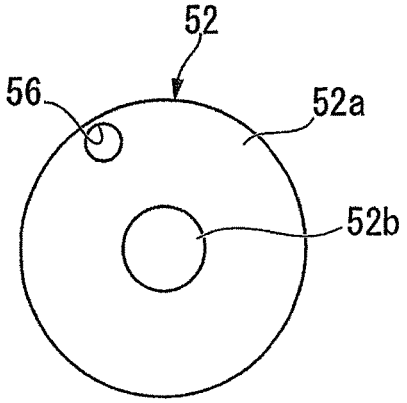
FIG. 9 is a plan view of a minute wheel according to the first embodiment.

FIG. 9 is a plan view of the minute wheel according to the first embodiment.

As illustrated in FIG. 9, the minute wheel 52 has a minute wheel transmittable portion 56 through which the light is transmittable. For example, the minute wheel transmittable portion 56 is formed in the same shape as the intermediate minute wheel transmittable portion 55 of the intermediate minute wheel 51 (refer to FIG. 8).

As illustrated in FIG. 3, the hour wheel 53 is arranged coaxially with the center axle O, and is rotatably and externally inserted into the center wheel & pinion 33. As illustrated in FIG. 2, the hour wheel 53 has an hour gear 53*a* which meshes with the minute wheel pinion 52*b* of the minute wheel 52. The hour hand 12 is attached to a lower end portion of the hour wheel 53.

Figure 10:
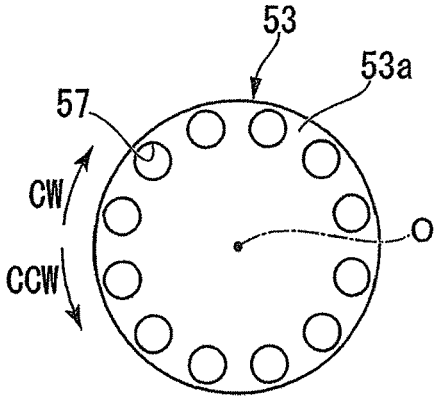
FIG. 10 is a plan view of an hour wheel according to the first embodiment.

FIG. 10 is a plan view of the hour wheel according to the first embodiment.

As illustrated in FIG. 10, the hour wheel 53 has 12 hour wheel transmittable portions 57 through which the light is transmittable. The 12 hour wheel transmittable portions 57 are circular through-holes, and are arrayed at equal intervals (interval of 30° in the present embodiment) along the circumferential direction of the hour wheel 53. The respective hour wheel transmittable portions 57 are disposed on the rotation trajectory of the center wheel transmittable portion 35 of the center wheel & pinion 33 when viewed in the axial direction.

As illustrated in FIG. 4, the hour detection wheel 54 is rotatably supported by the main plate 20. As illustrated in FIG. 2, the hour detection wheel 54 is arranged so as to partially overlap a portion where the intermediate minute gear 51*a* of the intermediate minute wheel 51 overlaps the minute gear 52*a* of the minute wheel 52 when viewed in the axial direction. The hour detection wheel 54 has an hour detection gear 54*a*. The hour detection gear 54*a* meshes with the minute wheel pinion 52*b* of the minute wheel 52.

Figure 11:
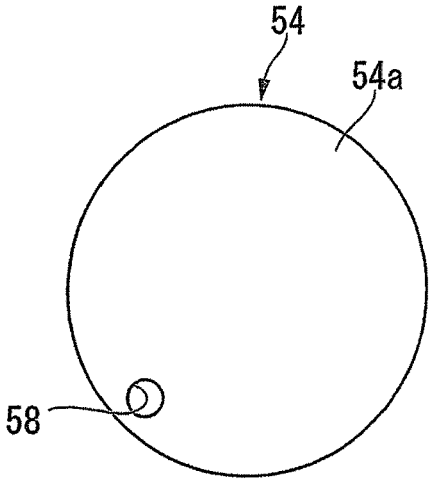
FIG. 11 is a plan view of an hour detection wheel according to the first embodiment.

FIG. 11 is a plan view of the hour detection wheel according to the first embodiment.

As illustrated in FIG. 11, the hour detection wheel 54 has an hour detection wheel transmittable portion 58 through which the light is transmittable. For example, the hour detection wheel transmittable portion 58 is formed in the same shape as the intermediate minute wheel transmittable portion 55 of the intermediate minute wheel 51 (refer to FIG. 8).

As illustrated in FIG. 3, the first light emitting element 61 is arranged on the lower side in the axial direction with respect to the center wheel & pinion 33, the minute detection wheel 34, and the second wheel & pinion 43, and is fixed to the main plate 20, for example. For example, the first light emitting element 61 is a light emitting diode (LED) or a laser diode (LD), and can emit the light upward. The first light emitting element 61 is connected to the light emitting control unit 18.

The first light receiving element 64 is arranged on the upper side in the axial direction, across the center wheel & pinion 33, the minute detection wheel 34, and the second wheel & pinion 43, and is fixed to the train wheel bridge 29, for example. For example, the first light receiving element 64 is a photo diode, and detects the light emitted from the first light emitting element 61. The first light receiving element 64 is connected to the detection control unit 19.

Through-holes 20*a* and 29*a* respectively penetrating the main plate 20 and the train wheel bridge 29 in the axial direction are formed at a position corresponding to a portion between the first light emitting element 61 and the first light receiving element 64 (hereinafter, referred to as a "first detection position"). The light emitted from the first light emitting element 61 is incident on the first light receiving element 64 after passing through the through-holes 29*a* and 20*a*.

The center wheel & pinion 33, the minute detection wheel 34, the second wheel & pinion 43, and the hour wheel 53 are arranged at the first detection position. The first detection position overlaps the rotation trajectory of a pair of the center wheel transmittable portions 35 of the center wheel & pinion 33 when viewed in the axial direction. In this manner, the first detection position overlaps the rotation trajectory of the first second wheel transmittable portion 45 and the second second wheel transmittable portion 46 of the second wheel & pinion 43 and the rotation trajectory of the hour wheel transmittable portion 57 of the hour wheel 53 when viewed in the axial direction. In addition, the first detection position overlaps the rotation trajectory of the minute detection wheel transmittable portion 37 of the minute detection wheel 34 when viewed in the axial direction.

When located at the first detection position, the center wheel transmittable portion 35 of the center wheel & pinion 33 can transmit the light emitted from the first light emitting element 61. In addition, when a pair of the center wheel transmittable portions 35 are located at other positions except for the first detection position, the center wheel & pinion 33 blocks the light emitted from the first light emitting element 61.

When located at the first detection position, any one of the first second wheel transmittable portion 45 and the second second wheel transmittable portion 46 of the second wheel & pinion 43 can transmit the light emitted from the first light emitting element 61. In addition, when both the first second wheel transmittable portion 45 and the second second wheel transmittable portion 46 are located at other positions except for the first detection position, the second wheel & pinion 43 blocks the light emitted from the first light emitting element 61.

When located at the first detection position, the hour wheel transmittable portion 57 of the hour wheel 53 can transmit the light emitted from the first light emitting element 61. In addition, when the hour wheel transmittable portion 57 is located at other positions except for the first detection position, the hour wheel 53 blocks the light emitted from the first light emitting element 61.

When located at the first detection position, the minute detection wheel transmittable portion 37 of the minute detection wheel 34 can transmit the light emitted from the first light emitting element 61. In addition, when the minute detection wheel transmittable portion 37 is located at other positions except for the first detection position, the minute detection wheel 34 blocks the light emitted from the first light emitting element 61.

The first center wheel transmittable portion 35A is disposed in the center wheel & pinion 33 so as to be located at the first detection position when the minute hand 13 attached to the center wheel & pinion 33 is arranged at the reference position indicating zero minutes on the dial 11.

In addition, the second second wheel transmittable portion 46 is disposed in the second wheel & pinion 43 so as to be located at the first detection position when the second hand 14 attached to a wheel axle 43*a* of the second wheel & pinion 43 is disposed in the reference position which indicates zero seconds on the dial 11.

The minute detection wheel transmittable portion 37 of the minute detection wheel 34 is disposed so as to be located at a position corresponding to the first center wheel transmittable portion 35A when viewed in the axial direction, in a state where the center wheel & pinion 33 can transmit the light emitted from the first light emitting element 61 to the first light receiving element 64 in the first center wheel transmittable portion 35A. That is, in a state where the first center wheel transmittable portion 35A is located at the first detection position, the minute detection wheel transmittable portion 37 is located at the first detection position.

As illustrated in FIG. 5, a central angle (θ, 360°−θ) formed by the first center wheel transmittable portion 35A and the second center wheel transmittable portion 35B in the center wheel & pinion 33 is set to multiplication of 360°/(M×N) as described above. Here, the gear ratio of the center wheel & pinion 33 with respect to the minute detection wheel 34 is set to 1/M. Accordingly, the rotation angle of the center wheel & pinion 33 whenever, the minute detection wheel transmittable portion 37 is brought into a state of being located at the first detection position is set to 360°/(M×N). Accordingly, when the first center wheel transmittable portion 35A and the second center wheel transmittable portion 35B of the center wheel & pinion 33 are located at the first detection position, the minute detection wheel transmittable portion 37 of the minute detection wheel 34 is also located at the first detection position (refer to FIG. 7).

As illustrated in FIG. 4, the second light emitting element 63 is arranged on the lower side in the axial direction with respect to the intermediate minute wheel 51, the minute wheel 52, and the hour detection wheel 54, and is fixed to the main plate 20. Similarly to the first light emitting element 61, the second light emitting element 63 is an LED or an LD, for example, and can emit the light upward. The second light emitting element 63 is connected to the light emitting control unit 18.

The second light receiving element 66 is disposed on the upper side in the axial direction, across the intermediate minute wheel 51, the minute wheel 52, and the hour detection wheel 54, and is fixed to the train wheel bridge 29, for example. Similarly to the first light receiving element 64, the second light receiving element 66 is a photo diode, for example, and detects the light emitted from the second light emitting element 63. The second light receiving element 66 is connected to the detection control unit 19.

Through-holes 20*c* and 29*c* respectively penetrating the main plate 20 and the train wheel bridge 29 in the axial direction are formed at a position corresponding to a portion between the second light emitting element 63 and the second light receiving element 66 (hereinafter, referred to as a "second detection position"). The light emitted from the second light emitting element 63 is incident on the second light receiving element 66 after passing through the through-holes 29*c* and 20*c*.

The second detection position overlaps the rotation trajectory of the intermediate minute wheel transmittable portion 55 of the intermediate minute wheel 51 when viewed in the axial direction. In addition, the second detection position overlaps the rotation trajectory of the minute wheel transmittable portion 56 of the minute wheel 52 when viewed in the axial direction. Furthermore, the second detection position overlaps the rotation trajectory of the hour detection wheel transmittable portion 58 of the hour detection wheel 54 when viewed in the axial direction.

When located at the second detection position, the intermediate minute wheel transmittable portion 55 of the intermediate minute wheel 51 can transmit the light emitted from the second light emitting element 63. In addition, when the intermediate minute wheel transmittable portion 55 is located other positions except for the second detection position, the intermediate minute wheel 51 blocks the light emitted from the second light emitting element 63.

When located at the second detection position, the minute wheel transmittable portion 56 of the minute wheel 52 can transmit the light emitted from the second light emitting element 63. In addition, when the minute wheel transmittable portion 56 is located other positions except for the second detection position, the minute wheel 52 blocks the light emitted from the second light emitting element 63.

When located at the second detection position, the hour detection wheel transmittable portion 58 of the hour detection wheel 54 can transmit the light emitted from the second light emitting element 63. In addition, when the hour detection wheel transmittable portion 58 is located other positions except for the second detection position, the hour detection wheel 54 blocks the light emitted from the second light emitting element 63.

The intermediate minute wheel transmittable portion 55 of the intermediate minute wheel 51 and the minute wheel transmittable portion 56 of the minute wheel 52 are located at the second detection position, in a state where the hour detection wheel transmittable portion 58 of the hour detection wheel 54 is located at the second detection position.

Hand Position Detection Operation

Next, a hand position detection operation according to the first embodiment will be described.

In the hand position detection operation, in order to detect the position of the hour hand 12, the minute hand 13, and the second hand 14, each rotation position of the center wheel & pinion 33, the second wheel & pinion 43, and the hour wheel 53 is detected. In the following description, description with regard to the position detection operation of the hour hand 12 will be omitted. In addition, the reference numeral of each configuration component in the following description is the same as that in FIGS. 2 to 11.

Figure 13:
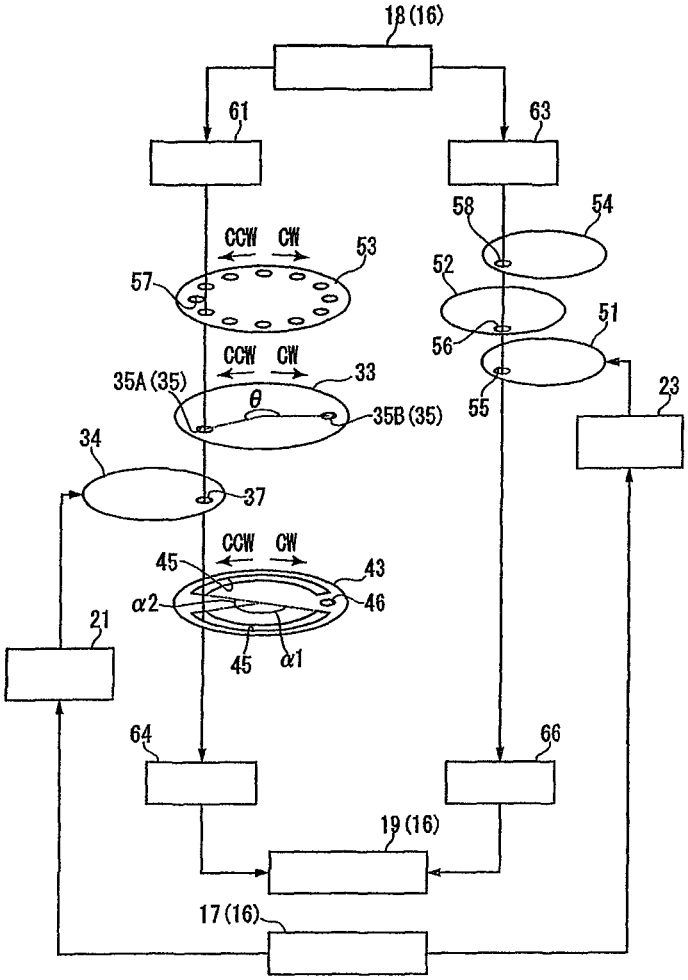
FIG. 13 is a block diagram of the movement according to the first embodiment.

FIG. 12 is a flowchart illustrating the hand position detection operation according to the first embodiment. FIG. 13 is a block diagram schematically illustrating the movement according to the first embodiment. FIG. 13 schematically illustrates a state where the hand position detection operation is completed.

As illustrated in FIG. 12, the hand position detection operation according to the present embodiment includes a minute transmitted state searching Step S10 of searching for the center wheel transmittable portion 35 of the center wheel & pinion 33, a second transmitted state searching Step S20 performed in a case where it is unclear whether any one of the first center wheel transmittable portion 35A and the second center wheel transmittable portion 35B is located at the first detection position when the minute transmitted state searching Step S10 is completed, and a second transmitted state searching Step S30 of searching for the second second wheel transmittable portion 46 of the second wheel & pinion 43.

First, before the above-described respective steps are performed, the hour wheel 53 is rotated by the third stepping motor 23 so that any one of the multiple hour wheel transmittable portions 57 is located at the first detection position. The first detection position represents a train wheel state when the intermediate minute wheel transmittable portion 55 of the intermediate minute wheel 51, the minute wheel transmittable portion 56 of the minute wheel 52, and the hour detection wheel transmittable portion 58 of the hour detection wheel 54 overlap each other at the same position. In this manner, the hour wheel 53 can always transmit the light emitted from the first light emitting element 61 to the first light receiving element 64 in the hour wheel transmittable portion 57.

Minute Transmitted State Searching Step

Next, the minute transmitted state searching Step S10 will be described.

The minute transmitted state searching Step S10 includes a transmitted state determination Step S11, a rotation angle determination Step S12, a first drive Step S13, a second drive Step S14, and Step S15.

First, in the minute transmitted state searching Step S10, the control unit 16 determines whether or not the first light receiving element 64 receives the light emitted from the first light emitting element 61 (transmitted state determination Step S11).

In the transmitted state determination Step S11, the light emitting control unit 18 of the control unit 16 supplies the power to the first light emitting element 61 so as to emit the light from the first light emitting element 61. In addition, in the transmitted state determination Step S11, the detection control unit 19 of the control unit 16 operates the first light receiving element 64, and determines whether the first light receiving element 64 receives the light. In the transmitted state determination Step S11, when any one of the first center wheel transmittable portion 35A and the second center wheel transmittable portion 35B of the center wheel & pinion 33, any one of the first second wheel transmittable portion 45 and the second second wheel transmittable portion 46 of the second wheel & pinion 43, and the minute detection wheel transmittable portion 37 of the minute detection wheel 34 are located at the first detection position, the first light receiving element 64 detects the light emitted from the first light emitting element 61 (refer to FIG. 13).

In the transmitted state determination Step S11, in a case where it is determined that the first light receiving element 64 receives the light emitted from the first light emitting element 61 (S11: Yes), the process proceeds to Step S15. In contrast, in the transmitted state determination Step 11, in a case where it is determined that the first light receiving element 64 does not receive the light emitted from the first light emitting element 61 (S11: No), the process proceeds to the rotation angle determination Step S12.

In the rotation angle determination Step S12, the control unit 16 determines whether or not the rotation angle of the center wheel & pinion 33 is equal to or larger than θ (240° in the present embodiment). In the rotation angle determination Step S12, the control unit 16 determines whether or not the rotation angle of the center wheel & pinion 33 after the hand position detection stored in the control unit 16 starts is equal to or larger than θ.

In the rotation angle determination Step S12, in a case where it is determined that the rotation angle of the center wheel & pinion 33 is equal to or larger than θ (S12: Yes), the process proceeds to the second drive Step S14. In the rotation angle determination Step S12, in a case where it is determined that the rotation angle of the center wheel & pinion 33 is smaller than θ(S12: No), the first drive Step S13 is performed.

In the first drive Step S13, the rotation control unit 17 causes the first stepping motor 21 to perform one step rotation driving, and rotates the center wheel & pinion 33 in the direction CW as much as the rotation angle (1° in the present embodiment) corresponding to one step of the first stepping motor 21. In the first drive Step S13, in response to the one step rotation driving of the first stepping motor 21, the minute detection wheel 34 is also rotated as much as the rotation angle (30° in the present embodiment) corresponding to one step of the first stepping motor 21. Subsequently, the transmitted state determination Step S11 is performed again.

Here, a case will be described where it is determined that the rotation angle of the center wheel & pinion 33 is equal to or larger than θ in the rotation angle determination Step S12 (S12: Yes).

Figure 14:
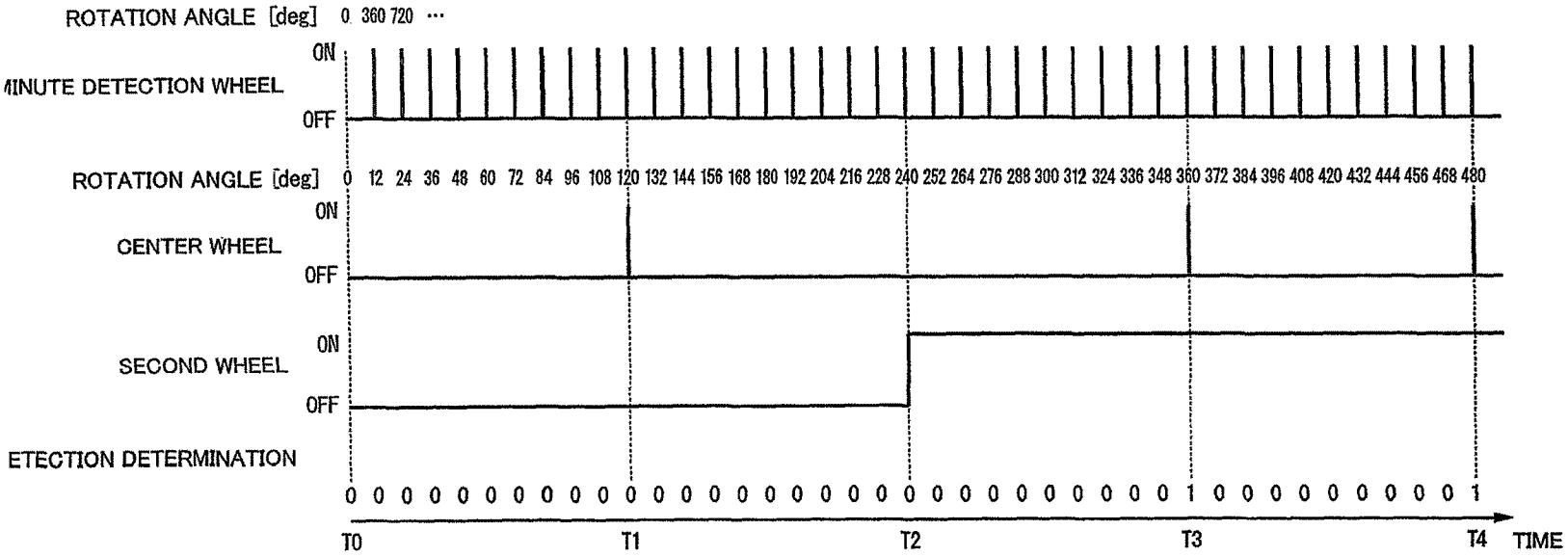
FIG. 14 is a timing chart illustrating a minute transmitted state searching step according to the first embodiment.

FIG. 14 is a timing chart illustrating the minute transmitted state searching step according to the first embodiment. A display of "ON" in the minute detection wheel, the center wheel & pinion, and the second wheel & pinion in FIG. 14 represents a state where each transmittable portion belonging to the minute detection wheel, the center wheel & pinion, and the second wheel & pinion is located at the first detection position. In addition, a display of "OFF" represents a state where each transmittable portion belonging to the minute detection wheel, the center wheel & pinion, and the second wheel & pinion is located at other positions except for the first detection position. In addition, a display of "0" in the detection determination in FIG. 14 represents a state where the first light receiving element 64 does not detect the light emitted from the first light emitting element 61, and a display of "1" represents a state where the first light receiving element 64 detects the light emitted from the first light emitting element 61.

If the transmitted state determination Step S11, the rotation angle determination Step S12, and the first drive Step S13 are repeatedly performed, the center wheel & pinion 33 and the minute detection wheel 34 are rotated. As illustrated in FIG. 14, whenever the minute detection wheel 34 is rotated once, the minute detection wheel transmittable portion 37 of the minute detection wheel 34 passes through the first detection position once. Accordingly, whenever the minute detection wheel 34 is rotated once, ON and OFF are repeated once. Whenever the center wheel & pinion 33 is rotated once, the first center wheel transmittable portion 35A and the second center wheel transmittable portion 35B of the center wheel & pinion 33 respectively pass through the first detection position once. Accordingly, whenever the center wheel & pinion 33 is rotated once, ON and OFF are repeated twice. When the center wheel & pinion 33 is ON, the minute detection wheel 34 is also ON.

If the center wheel & pinion 33 is rotated as much as θ at the most, any one of the first center wheel transmittable portion 35A and the second center wheel transmittable portion 35B passes through the first detection position (refer to FIG. 13). Therefore, even if the center wheel & pinion 33 is rotated as much as θ, in a case where the first light receiving element 64 does not detect the light emitted from the first light emitting element 61, the first second wheel transmittable portion 45 and the second second wheel transmittable portion 46 of the second wheel & pinion 43 are located at other positions except for the first detection position.

As illustrated in FIG. 12, in the second drive Step S14, the rotation control unit 17 drives the second stepping motor 22 so as to rotate the second wheel & pinion 43 as much as a predetermined angle β(90° in the present embodiment). In the present embodiment, a first central angle α1 formed by both end portions of the first second wheel transmittable portion 45 is set to 100°, and a second central angle α2 between a pair of the first second wheel transmittable portions 45 in the circumferential direction of the second wheel & pinion 43 is set to 80°. Therefore, by rotating the second wheel & pinion 43 as much as the predetermined angle β (90° in the present embodiment) which is in a range from α2 to α1, the first second wheel transmittable portion 45 located at other positions except for the first detection position can be moved so as to be located at the first detection position (time T2 in FIG. 14). Subsequently, the rotation angle of the center wheel & pinion 33 which is stored in the control unit 16 is set to 0°, and the transmitted state determination Step S11 is performed again. Thereafter, the rotation angle determination Step S12, the first drive Step S13, and the transmitted state determination Step S11 are repeatedly performed again. In this manner, the first light receiving element 64 can detect any one of the first center wheel transmittable portion 35A and the second center wheel transmittable portion 35B (for example, time T3 in FIG. 14).

In Step S15, the control unit 16 determines whether or not the rotation angle of the center wheel & pinion 33 which is stored in the control unit 16 is 360°−θ (120° in the present embodiment). In Step S15, in a case where the control unit 16 determines that the rotation angle of the center wheel & pinion 33 is equal to or larger than 360°−θ (S15: Yes), the minute transmitted state searching Step S10 is completed, and the process proceeds to the second transmitted state searching Step S30. In contrast, in Step S15, in a case where the control unit 16 determines that the rotation angle of the center wheel & pinion 33 is smaller than 360°−θ (S15: No), the minute transmitted state searching Step S10 is completed, and the process proceeds to the second transmitted state searching Step S20.

Here, a case will be described where the rotation angle of the center wheel & pinion 33 which is stored in the control unit 16 is equal to or larger than 360°−θ (S15: Yes).

When it is determined as Yes in the transmitted state determination Step S11, in a case where the first center wheel transmittable portion 35A is located at the first detection position, the rotation angle of the center wheel & pinion 33 which is stored in the control unit 16 in Step S15 is equal to or larger than 0° and smaller than θ. In addition, when it is determined as Yes in the transmitted state determination Step S11, in a case where the second center wheel transmittable portion 35B is located at the first detection position, the rotation angle of the center wheel & pinion 33 which is stored in the control unit 16 in Step S15 is equal to or larger than 0° and smaller than 360°−θ. Therefore, in a case where it is determined as Yes in Step S15, the first center wheel transmittable portion 35A is located at the first detection position. Accordingly, in a case where it is determined as Yes in Step S15, detecting the rotation position of the center wheel & pinion 33 is completed, and the minute hand 13 is completely arranged at the reference position.

Second Transmitted State Searching Transfer Step

Next, the second transmitted state searching Step S20 will be described.

The second transmitted state searching Step S20 includes Step S21, Step S22, Step S23, and Step S24.

In the second transmitted state searching Step S20, Step S21 is first performed. In Step S21, the rotation control unit 17 drives the first stepping motor 21 so that the center wheel & pinion 33 performs rotation driving in the direction CW as much as the angle θ. In a case where the first center wheel transmittable portion 35A is located at the first detection position when Step S21 is performed, Step S21 is performed so as to move the second center wheel transmittable portion 35B to the first detection position. In a case where the second center wheel transmittable portion 35B is located at the first detection position when Step S21 is performed, Step S21 is performed so as to move the first center wheel transmittable portion 35A and the second center wheel transmittable portion 35B to other positions except for the first detection position.

Next, Step S22 is performed. In Step S22, similarly to the transmitted state determination Step S11, the control unit 16 determines whether or not the first light receiving element 64 receives the light emitted from the first light emitting element 61.

In Step S22, in a case where it is determined that the first light receiving element 64 receives the light emitted from the first light emitting element 61 (S22: Yes), the process proceeds to Step S23. In Step S22, in a case where it is determined that the first light receiving element 64 does not receive the light emitted from the first light emitting element 61 (S22: No), the process proceeds to Step S24.

In a case where it is determined as Yes in Step S22, at that time, the second center wheel transmittable portion 35B is located at the first detection position. Accordingly, detecting the rotation position of the center wheel & pinion 33 is completed.

In Step S23, the center wheel & pinion 33 is caused to perform rotation driving in the direction CW as much as the angle θ. In this manner, the first center wheel transmittable portion 35A can be moved to the first detection position, thereby completely arranging the minute hand 13 at the reference position. After Step S23 is performed, the second transmitted state searching Step S20 is completed, and the process proceeds to the second transmitted state searching Step S30.

In a case where it is determined as No in Step S22, when Step S15 is performed, the second center wheel transmittable portion 35B is located at the first detection position. Accordingly, detecting the rotation position of the center wheel & pinion 33 is completed.

In Step S24, the center wheel & pinion 33 is caused to perform rotation driving in the direction CW as much as the angle 360°−θ. In this manner, the first center wheel transmittable portion 35A can be moved to the first detection position, thereby completely arranging the minute hand 13 at the reference position. After Step S24 is performed, the second transmitted state searching Step S20 is completed, and the process proceeds to the second transmitted state searching Step S30.

Second Transmitted State Searching Step

Next, the second transmitted state searching Step S30 will be described.

The second transmitted state searching Step S30 includes Step S31 and Step S32.

Figure 15:
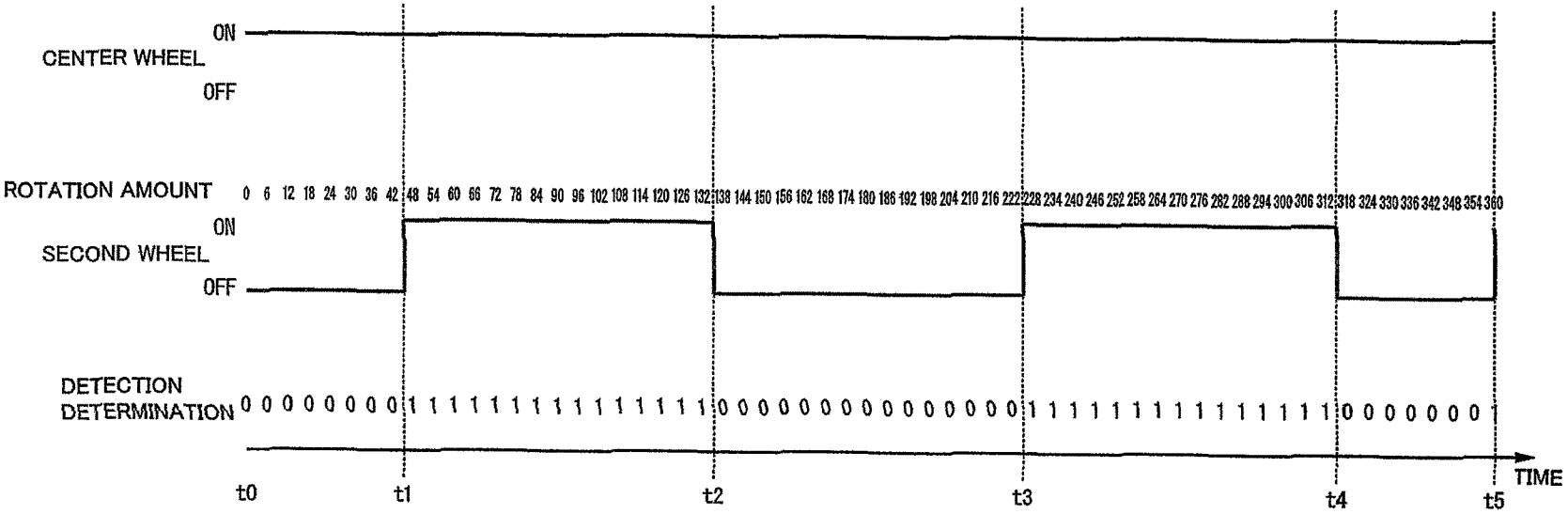
FIG. 15 is a timing chart illustrating a second transmitted state searching step according to the first embodiment.

FIG. 15 is a timing chart illustrating the second transmitted state searching step according to the first embodiment. The display of "ON" in the center wheel & pinion and the second wheel & pinion in FIG. 15 represents a state where each transmittable portion belonging to the center wheel & pinion and the second wheel & pinion is located at the first detection position. In addition, the display of "OFF" represents a state where each transmittable portion belonging to the center wheel & pinion and the second wheel & pinion is located at other positions except for the first detection position. In addition, the display of "0" in the detection determination in FIG. 15 represents a state where the first light receiving element 64 does not detect the light emitted from the first light emitting element 61, and the display of "1" represents a state where the first light receiving element 64 detects the light emitted from the first light emitting element 61.

First, the second transmitted state searching Step S30 will be schematically described. As illustrated in FIG. 15, in the second transmitted state searching Step S30, the rotation control unit 17 drives the second stepping motor 22. While the second wheel & pinion 43 is rotated, the first light receiving element 64 is caused to receive the light emitted from the first light emitting element 61. In this case, the first light receiving element 64 is caused to detect a light transmitted pattern corresponding to a shape, a position, and the number of the first second wheel transmittable portions 45 and the second second wheel transmittable portions 46. Then, the second second wheel transmittable portion 46 is detected by determining whether or not the light transmitted pattern detected in the first light receiving element 64 is a desirable pattern. In this manner, the rotation position of the second wheel & pinion 43 is detected.

Hereinafter, the second transmitted state searching Step S30 will be described in detail.

Figure 16:
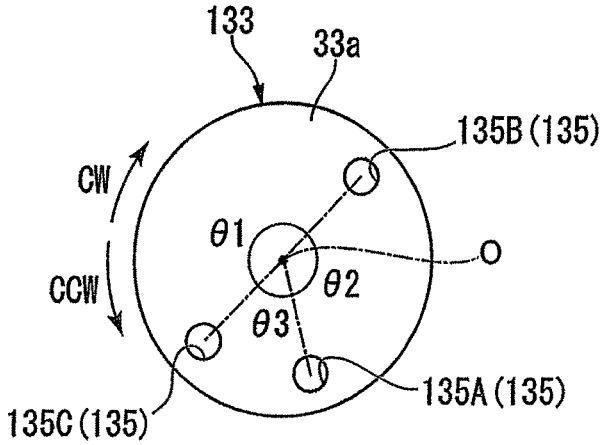
FIG. 16 is a plan view of a center wheel & pinion according to a second embodiment.

In the second transmitted state searching Step S30, detecting the rotation position of the center wheel & pinion 33 is completed, and the first center wheel transmittable portion 35A is located at the first detection position (refer to FIG. 13). Accordingly, as illustrated in FIG. 16, the center wheel & pinion 33 is always in a state of ON.

As illustrated in FIG. 13, in the second transmitted state searching Step S30, Step S31 is first performed. In Step S31, the control unit 16 detects the desirable pattern. Specifically, in Step S31, the control unit 16 determines whether or not a signal detected in the first light receiving element 64 is the desirable pattern.

In Step S31, in a case where it is determined that the desirable pattern is detected (S31: Yes), the second transmitted state searching Step S30 is completed. In Step S31, in a case where it is determined that the desirable pattern is not detected (S31: No), Step S32 is performed.

In Step S32, the rotation control unit 17 causes the second stepping motor 22 to perform rotation driving one step, and rotates the second wheel & pinion 43 in the direction CW as much as the rotation angle (6° in the present embodiment) corresponding to one step of the second stepping motor 22. Subsequently, Step S31 is performed again.

A detection signal by the first light receiving element 64 in the second transmitted state searching Step S30 according to the embodiment will be described. As illustrated in FIGS. 13 and 15, if Step S31 and Step S32 are repeatedly performed, the second wheel & pinion 43 is rotated. A pair of the first second wheel transmittable portion 45 and the second second wheel transmittable portion 46 of the second wheel & pinion 43 pass through the first detection position once whenever the second wheel & pinion 43 is rotated once. The second wheel & pinion 43 has the first second wheel transmittable portion 45 having a long hole. Accordingly, the second wheel & pinion 43 is in a continuously transmitted state over a period while the first second wheel transmittable portion 45 is located at the first detection position (refer to a period from time t1 to time t2 in FIG. 15 and a period from t3 to time t4).

In the second transmitted state searching Step S30, the center wheel & pinion 33 is always in a state of ON. Therefore, when the second wheel & pinion 43 is ON, the first light receiving element 64 detects the light emitted from the first light emitting element 61.

The second stepping motor 22 rotates the second wheel & pinion 43 as many as 16 steps in the direction CW after the first light receiving element 64 finally detects one first second wheel transmittable portion 45 and until the first light receiving element 64 starts to detect the other first second wheel transmittable portion 45 (for example, a period from time t2 to time t3 in FIG. 15).

Here, a case will be described where the second second wheel transmittable portion 46 is present between one first second wheel transmittable portion 45 and the other first second wheel transmittable portion 45. In this case, after the first light receiving element 64 finally detects the light transmitted through one first second wheel transmittable portion 45 in Step S32, Step S31 and Step S32 are repeatedly performed. In this manner, if the second stepping motor 22 rotates the second wheel & pinion 43 as many as 8 steps, the second second wheel transmittable portion 46 is brought into a state of being located at the first detection position. In this case, in Step S32, the first light receiving element 64 detects once the light transmitted through the second second wheel transmittable portion 46 (time t5 in FIG. 15).

In order to detect the second second wheel transmittable portion 46, the control unit 16 sets the light transmitted pattern (desirable pattern) to be detected in the first light receiving element 64 to be a pattern showing "1-1-0-0-0-0-0-0-0-1" whenever the second wheel & pinion 43 is rotated as much as 6° (whenever Step S31 and Step S32 are performed). In this manner, when the first light receiving element 64 detects the desirable pattern, the control unit 16 can determine that the second second wheel transmittable portion 46 is in a state of being located at the first detection position after one first second wheel transmittable portion 45 passes through the first detection position.

As described above, in Step S31, in a case where it is determined that the desirable pattern is detected (S31: Yes), at that time, the second second wheel transmittable portion 46 is located at the second detection position. Accordingly, detecting the rotation position of the second wheel & pinion 43 is completed, and the secondhand 14 is completely arranged at the reference position. Subsequently, the second transmitted state searching Step S30 is completed, and the hand position detection operation is completed.

As described above, in the present embodiment, the multiple center wheel transmittable portions 35 are disposed in parallel at the unequal angular interval in the circumferential direction of the center axle O. Therefore, the rotation position of the center wheel & pinion 33 can be determined by detecting the circumferential distance between the center wheel transmittable portions 35 adjacent to each other in the circumferential direction of the center axle O. In this case, while the center wheel & pinion 33 is rotated, the first light receiving element 64 is caused to detect the light emitted from the first light emitting element 61 and transmitted through the center wheel transmittable portion 35 so as to determine the rotation amount of the center wheel & pinion 33 and the presence or absence of the center wheel transmittable portion 35. In this manner, it is possible to detect the circumferential distance between the center wheel transmittable portions 35. Accordingly, compared to a configuration in which one center wheel transmittable portion is disposed to the center wheel & pinion 33, it is possible to minimize the rotation amount of the center wheel & pinion 33, when the rotation position of the center wheel & pinion 33 is determined in response to the position detection of the minute hand 13. Therefore, it is possible to shorten time for operating the first light emitting element 61, and thus, it is possible to reduce power consumption when the hand position is detected.

In addition, in the minute detection wheel 34 according to the present embodiment, the gear ratio of the center wheel & pinion 33 with respect to the minute detection wheel 34 is set to 1/M. Therefore, if the first stepping motor 21 is driven so as to concurrently rotate the center wheel & pinion 33 and the minute detection wheel 34, the center wheel & pinion 33 is rotated as much as 360°/M whenever the minute detection wheel transmittable portion 37 is brought into a state of being located at the first detection position. The angular interval of the center wheel transmittable portions 35 adjacent to each other in the circumferential direction of the center axle O is set to the multiplication of 360°/M. Accordingly, the center wheel & pinion 33 and the minute detection wheel 34 are disposed for the first stepping motor 21 so that the minute detection wheel transmittable portion 37 is located at the first detection position in a state where any one of the center wheel transmittable portions 35 is located at the first detection position. In this manner, when each center wheel transmittable portion 35 is located at the first detection position, the minute detection wheel transmittable portion 37 can be concurrently located at the first detection position.

Furthermore, in the minute detection wheel 34, the gear ratio of the center wheel & pinion 33 with respect to the minute detection wheel 34 is set to 1/M (M is an integer). Therefore, the rotation angle of the minute detection wheel 34 with respect to the first stepping motor 21 becomes larger than the rotation angle of the center wheel & pinion 33. In this manner, in a state where the center wheel transmittable portion 35 and the minute detection wheel transmittable portion 37 are located at the first detection position and the light emitted from the first light emitting element 61 can be transmitted to the first light receiving element 64, the minute detection wheel transmittable portion 37 can be caused to retreat from the first detection position earlier than the center wheel transmittable portion 35. Therefore, even in a case where the rotation angle of the center wheel & pinion 33 for one step driving of the first stepping motor 21 is small, one step of the first stepping motor 21 enables the first light receiving element 64 to be shifted between a state where the light emitted from the first light emitting element 61 can be detected and a state where the light cannot be detected.

Through the above-described processes, it is possible to reliably detect the rotation position of the center wheel & pinion 33 in response to the position detection of the minute hand 13, and it is possible to reduce power consumption when the hand position is detected.

In addition, in the present embodiment, the first second wheel transmittable portion 45 is disposed on the rotation trajectory of the center wheel transmittable portion 35 when viewed in the axial direction. Accordingly, in a case where the center wheel transmittable portion 35, the minute detection wheel transmittable portion 37, and the first second wheel transmittable portion 45 are located at the first detection position, the first light receiving element 64 detects the light emitted from the first light emitting element 61.

The center wheel & pinion 33 is rotated to the maximum as much as θ by repeatedly performing the transmitted state determination Step S11, the rotation angle determination Step S12, and the first drive Step S13. Accordingly, the center wheel transmittable portion 35 passes through the first detection position at least once. In this manner, it is possible to determine whether or not the first second wheel transmittable portion 45 is located at the first detection position.

Subsequently, in a case where a region other than the first second wheel transmittable portion 45 of the second wheel & pinion 43 (hereinafter, referred to as a "light-blocking region") is located at the first detection position, in the second drive Step S14, the second wheel & pinion 43 is rotated as much as the predetermined angle β which is equal to or larger than the second central angle α2 corresponding to a portion between the end portions of the first second wheel transmittable portion 45 corresponding to the light-blocking region and which is equal to or smaller than the first central angle α1 formed by both end portions of the first second wheel transmittable portion 45. In this manner, the light-blocking region can be caused to retreat from the first detection position, and the first second wheel transmittable portion 45 can be moved to the first detection position.

Through the above-described processes, it is possible to more quickly determine whether or not the first second wheel transmittable portion 45 is located at the first detection position, compared to a configuration in which the determination is made by rotating the center wheel & pinion 33 as much as 360° as in the related art. In addition, in a case where the light-blocking region is located at the first detection position, the second drive Step S14 is performed once. In this manner, it is not necessary to determine again whether or not the first second wheel transmittable portion 45 is located at the first detection position, and it is possible to minimize the rotation amount of the center wheel & pinion 33 in determining the rotation position of the center wheel & pinion 33. Therefore, it is possible to shorten time for operating the first light emitting element 61, and thus, it is possible to reduce power consumption when the hand position is detected.

The electronic timepiece 1 according to the present embodiment includes the above-described movement 10. Accordingly, it is possible to reduce power consumption when the hand position is detected.

Second Embodiment

Next, a second embodiment will be described.

FIG. 16 is a plan view of a center wheel & pinion according to the second embodiment.

In the first embodiment illustrated in FIG. 5, the center wheel & pinion 33 has a pair of the center wheel transmittable portions 35. In contrast, the second embodiment illustrated in FIG. 16 is different from the first embodiment in that a center wheel & pinion 133 has three center wheel transmittable portions 135. The same reference numerals will be given to configurations which are the same as those according to the first embodiment illustrated in FIGS. 1 to 15, and detailed description thereof will be omitted.

As illustrated in FIG. 16, the center wheel & pinion 133 has the three center wheel transmittable portions 135 (first transmittable portions) which are disposed on the same rotation trajectory, and through which the light is transmittable. The three center wheel transmittable portions 135 are circular through-holes formed in the same shape, for example. The three center wheel transmittable portions 135 are disposed in parallel at an unequal interval in the circumferential direction of the center axle O. The angular interval of the center wheel transmittable portions 135 is set to the multiplication of 360°/(M×N) (multiplication of 12° in the present embodiment). The maximum central angle θ1 in the central angle formed by the center wheel transmittable portions 135 adjacent to each other in the circumferential direction of the center axle O is set to 180°, for example. The second largest central angle θ2 in the central angle formed by the center wheel transmittable portions 135 adjacent to each other in the circumferential direction of the center axle O is set to 120°, for example. The three center wheel transmittable portions 135 have a first center wheel transmittable portion 135A, a second center wheel transmittable portion 135B disposed at a position where the second center wheel transmittable portion 135B is rotated from the first center wheel transmittable portion 135A in the direction CCW as much as the angle θ2, and a third center wheel transmittable portion 135C disposed at a position where the third center wheel transmittable portion 135C is rotated from the second center wheel transmittable portion 135B in the direction CCW as much as the angle θ1. A central angle θ3 between the first center wheel transmittable portion 135A and the third center wheel transmittable portion 135C is set to 360°−θ1−θ2 (60° in the present embodiment).

Next, a hand position detection operation according to the second embodiment will be described.

Figure 17:
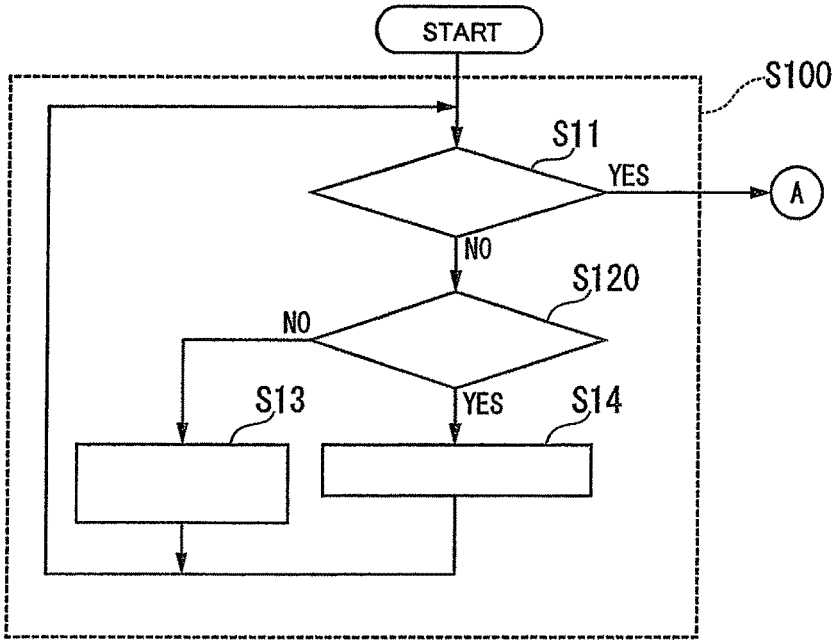
FIG. 17 is a flowchart illustrating a hand position detection operation according to the second embodiment.
Figure 18:
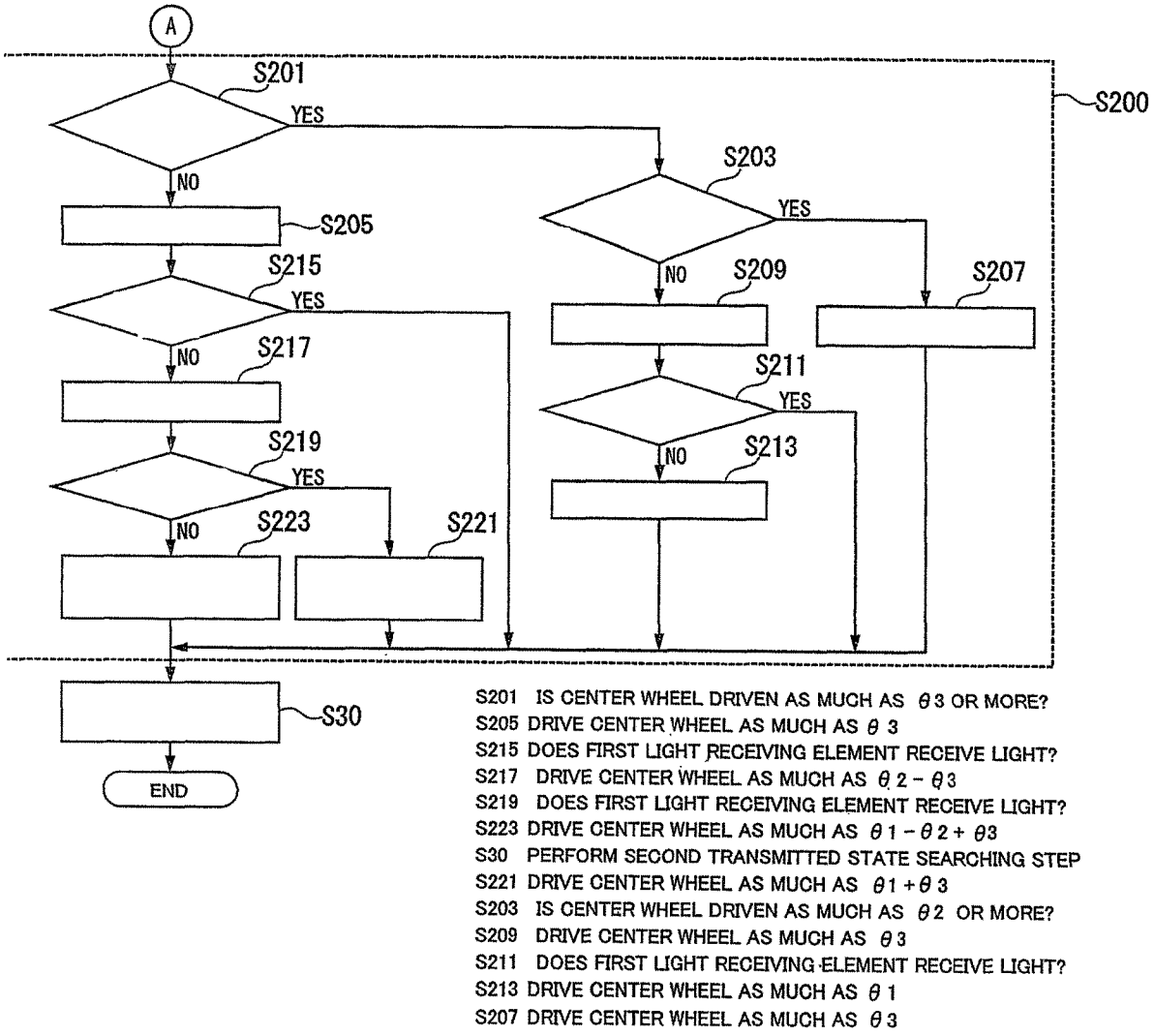
FIG. 18 is a flowchart illustrating the hand position detection operation according to the second embodiment.
Figure 19:
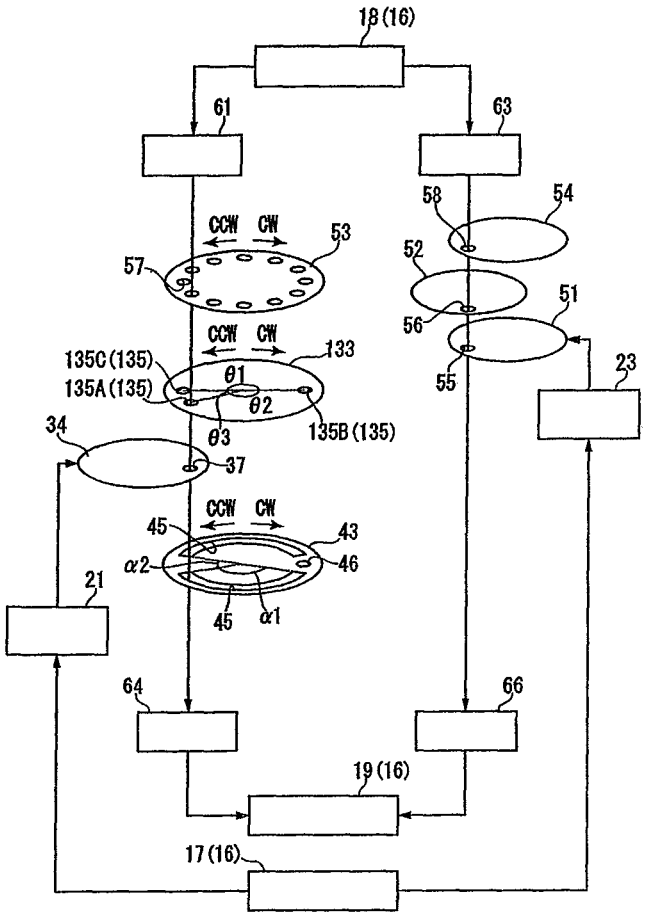
FIG. 19 is a block diagram of the movement according to the second embodiment.

FIGS. 17 and 18 are flowcharts illustrating the hand position detection operation according to the second embodiment. FIG. 19 is a block diagram schematically illustrating the movement according to the second embodiment. FIG. 19 schematically illustrates a state where the hand position detection operation is completed.

As illustrated in FIGS. 17 and 18, the hand position detection operation according to the present embodiment includes a minute transmitted state searching Step S100 of searching for the center wheel transmittable portion 135 of the center wheel & pinion 133, a second transmitted state searching Step S200 of locating the first center wheel transmittable portion 135A at the first detection position, and a second transmitted state searching Step S30 of searching for the second second wheel transmittable portion 46 of the second wheel & pinion 43.

First, similarly to the first embodiment, before the above-described respective steps are performed, the third stepping motor 23 rotates the hour wheel 53 so that any one of the multiple hour wheel transmittable portions 57 is located at the first detection position. In this manner, the hour wheel 53 can always transmit the light emitted from the first light emitting element 61 to the first light receiving element 64 in the hour wheel transmittable portions 57.

Minute Transmitted State Searching Step

Next, the minute transmitted state searching Step S100 will be described.

As illustrated in FIG. 17, the minute transmitted state searching Step S100 includes a transmitted state determination Step S11, a rotation angle determination Step S120, a first drive Step S13, and a second drive Step S14.

In the minute transmitted state searching Step S100, the transmitted state determination Step S11 is performed. In the transmitted state determination Step S11, in a case where it is determined that the first light receiving element 64 receives the light emitted from the first light emitting element 61 (S11: Yes), the process proceeds to the second transmitted state searching Step S200. In contrast, in the transmitted state determination Step S11, in a case where it is determined that the first light receiving element 64 does not receive the light emitted from the first light emitting element 61 (S11: No), the process proceeds to the rotation angle determination Step S120.

In the rotation angle determination Step S120, the control unit 16 determines whether or not the rotation angle of the center wheel & pinion 133 is equal to or larger than θ1 (180° in the present embodiment). In the rotation angle determination Step S120, the control unit 16 determines whether or not the rotation angle of the center wheel & pinion 133 after the hand position detection stored in the control unit 16 starts is equal to or larger than θ1.

In the rotation angle determination Step S120, in a case where it is determined that the rotation angle of the center wheel & pinion 133 is equal to or larger than θ1 (S120: Yes), the process proceeds to the second drive Step S14. In contrast, in the rotation angle determination Step S120, in a case where it is determined that the rotation angle of the center wheel & pinion 133 is smaller than θ1 (S120: No), the process proceeds to the first drive Step S13. Subsequently, the transmitted state determination Step S11 is performed again.

Here, a case will be described where it is determined, in the rotation angle determination Step S120, that the rotation angle of the center wheel & pinion 133 is equal to or larger than θ1 (S120: Yes).

If the center wheel & pinion 133 is rotated as much as θ1 at the most, any one of a first center wheel transmittable portion 135A, a second center wheel transmittable portion 135B, and a third center wheel transmittable portion 135C passes through the first detection position. Therefore, even if the center wheel & pinion 133 is rotated as much as θ1, in a case where the first light receiving element 64 does not detect the light emitted from the first light emitting element 61, the first second wheel transmittable portion 45 and the second second wheel transmittable portion 46 of the second wheel & pinion 43 are located at other positions except for the first detection position. Accordingly, the second drive Step S14 is performed so as to move the first second wheel transmittable portion 45 to the first detection position. Subsequently, the rotation angle of the center wheel & pinion 133 which is stored in the control unit 16 is set to 0°, and the transmitted state determination Step S11 is performed again. Thereafter, the rotation angle determination Step S120, the first drive Step S13, and the transmitted state determination Step S11 are repeatedly performed. In this manner, the first light receiving element 64 can detect any one of the first center wheel transmittable portion 135A, the second center wheel transmittable portion 135B, and the third center wheel transmittable portion 135C.

Second Transmitted State Searching Transfer Step

Next, the second transmitted state searching Step S200 will be described.

As illustrated in FIG. 18, the second transmitted state searching Step S200 includes Step S201, Step S203, Step S205, Step S207, Step S209, Step S211, Step S213, Step S215, Step S217, Step S219, Step S221, and Step S223.

In the second transmitted state searching Step S200, Step S201 is first performed. In Step S201, the control unit 16 determines whether or not the rotation angle of the center wheel & pinion 133 which is stored in the control unit 16 is equal to or larger than θ3 (60° in the present embodiment). In Step S201, in a case where it is determined that the rotation angle of the center wheel & pinion 133 is equal to or larger than θ3 (S201: Yes), the process proceeds to Step S203. In Step S203, in a case where it is determined that the rotation angle of the center wheel & pinion 133 is smaller than θ3 (S201: No), the process proceeds to Step S205.

Here, a case will be described where it is determined in Step S201 that the rotation angle of the center wheel & pinion 133 which is stored in the control unit 16 is equal to or larger than θ3 (S201: Yes).

When it is determined as Yes in the transmitted state determination Step S11, in a case where the first center wheel transmittable portion 135A is located at the first detection position, the rotation angle of the center wheel & pinion 133 which is stored in the control unit 16 in Step S201 is equal to or larger than 0° and smaller than θ3. In addition, when it is determined as Yes in the transmitted state determination Step S11, in a case where the second center wheel transmittable portion 135B is located at the first detection position, the rotation angle of the center wheel & pinion 133 which is stored in the control unit 16 in Step S201 is equal to or larger than 0° and smaller than θ2. In addition, when it is determined as Yes in the transmitted state determination Step S11, in a case where the third center wheel transmittable portion 135C is located at the first detection position, the rotation angle of the center wheel & pinion 133 which is stored in the control unit 16 in Step S201 is equal to or larger than 0° and smaller than θ1. Therefore, in a case where it is determined as Yes in Step S201, the second center wheel transmittable portion 135B or the third center wheel transmittable portion 135C is located at the first detection position.

In Step S203, the control unit 16 determines whether or not the rotation angle of the center wheel & pinion 133 which is stored in the control unit 16 is equal to or larger than θ2 (120° in the present embodiment). In Step S203, in a case where it is determined that the rotation angle of the center wheel & pinion 133 is equal to or larger than θ2 (S203: Yes), the process proceeds to Step S207. In Step S203, in a case where it is determined that the rotation angle of the center wheel & pinion 133 is smaller than θ2 (S203: No), the process proceeds to Step S209.

In a case where it is determined as Yes in Step S203, in the above-described determination manner similar to that in Step S201, the third center wheel transmittable portion 1350 is located at the first detection position. Accordingly, in a case where it is determined as Yes in Step S203, detecting the rotation position of the center wheel & pinion 133 is completed.

In Step S207, the center wheel & pinion 133 is caused to perform rotation driving in the direction CW as much as the angle θ3. In this manner, the first center wheel transmittable portion 135A can be moved to the first detection position, and the minute hand 13 is completely arranged at the reference position. Subsequently, the process proceeds to the second transmitted state searching Step S30.

In Step S209, the center wheel & pinion 133 is caused to perform rotation driving in the direction CW as much as the angle θ3. Subsequently, Step S211 is performed.

In Step S211, similarly to the transmitted state determination Step S11, it is determined whether or not the first light receiving element 64 receives the light emitted from the first light emitting element 61. In Step S211, in a case where it is determined that the first light receiving element 64 receives the light emitted from the first light emitting element 61 (S211: Yes), the process proceeds to the second transmitted state searching Step S30. In contrast, in Step S211, in a case where it is determined that the first light receiving element 64 does not receive the light emitted from the first light emitting element 61 (S211: No), the process proceeds to Step S213.

In a case where it is determined as Yes in Step S211, when Step S203 is performed, the third center wheel transmittable portion 135C is located at the first detection position. When Step S211 is performed, the first center wheel transmittable portion 135A is located at the first detection position. Accordingly, detecting the rotation position of the center wheel & pinion 133 is completed, and the minute hand 13 is completely arranged at the reference position. Subsequently, the process proceeds to the second transmitted state searching Step S30.

In a case where it is determined as No in Step S211, when Step S203 is performed, the second center wheel transmittable portion 135B is located at the first detection position. Accordingly, detecting the rotation position of the center wheel & pinion 133 is completed.

In Step S213, the center wheel & pinion 133 is caused to perform rotation driving in the direction CW as much as the angle θ1. In this manner, the first center wheel transmittable portion 135A can be moved to the first detection position, and the minute hand 13 is completely arranged at the reference position. Subsequently, the process proceeds to the second transmitted state searching Step S30.

In Step S205, the center wheel & pinion 133 is caused to perform rotation driving in the direction CW as much as the angle θ3. Subsequently, Step S215 is performed.

In Step S215, similarly to Step S211, it is determined whether or not the first light receiving element 64 receives the light emitted from the first light emitting element 61. In Step S215, in a case where it is determined that the first light receiving element 64 receives the light emitted from the first light emitting element 61 (S215: Yes), the process proceeds to the second transmitted state searching Step S30. In contrast, in Step S215, in a case where it is determined that the first light receiving element 64 does not receive the light emitted from the first light emitting element 61 (S215: No), the process proceeds to Step S217.

In a case where it is determined as Yes in Step S215, when Step S201 is performed, the third center wheel transmittable portion 135C is located at the first detection position. When Step S215 is performed, the first center wheel transmittable portion 135A is located at the first detection position. Accordingly, detecting the rotation position of the center wheel & pinion 133 is completed, and the minute hand 13 is completely arranged at the reference position. Subsequently, the process proceeds to the second transmitted state searching Step S30.

In a case where it is determined as No in Step S215, when Step S201 is performed, the first center wheel transmittable portion 135A or the second center wheel transmittable portion 135B is located at the first detection position. When Step S215 is performed, a portion moved from the first center wheel transmittable portion 135A of the center wheel & pinion 133 in the direction CCW as much as the angle θ3 or a portion moved from the second center wheel transmittable portion 135B in the direction CCW as much as the angle θ3 is located at the first detection position.

In Step S217, the center wheel & pinion 133 is caused to perform rotation driving in the direction CW as much as the angle θ2−θ3. Subsequently, Step S219 is performed.

In Step S219, similarly to Step S215, it is determined whether or not the first light receiving element 64 receives the light emitted from the first light emitting element 61. In Step S219, in a case where it is determined that the first light receiving element 64 receives the light emitted from the first light emitting element 61 (S219: Yes), the process proceeds to Step S221. In contrast, in Step S219, in a case where it is determined that the first light receiving element 64 does not receive the light emitted from the first light emitting element 61 (S219: No), the process proceeds to Step S223.

In a case where it is determined as Yes in Step S219, when Step S215 is performed, a portion moved from the first center wheel transmittable portion 135A of the center wheel & pinion 133 in the direction CCW as much as the angle θ3 is located at the first detection position. In addition, when Step S219 is performed, the second center wheel transmittable portion 135B is located at the first detection position. Accordingly, detecting the rotation position of the center wheel & pinion 133 is completed.

In Step S221, the center wheel & pinion 133 is caused to perform rotation driving in the direction CW as much as the angle θ1+θ3. In this manner, the first center wheel transmittable portion 135A can be moved to the first detection position, and the minute hand 13 is completely arranged at the reference position. Subsequently, the process proceeds to the second transmitted state searching Step S30.

In a case where it is determined as No in Step S219, when Step S215 is performed, a portion moved from the second center wheel transmittable portion 135B of the center wheel & pinion 133 in the direction CCW as much as the angle θ3 is located at the first detection position. In addition, when Step S219 is performed, a portion moved from the second center wheel transmittable portion 135B of the center wheel & pinion 133 in the direction CCW as much as the angle θ2 is located at the first detection position. Accordingly, detecting the rotation position of the center wheel & pinion 133 is completed.

In Step S223, the center wheel & pinion 133 is caused to perform rotation driving in the direction CW as much as the angle θ1−θ2+θ3. In this manner, the first center wheel transmittable portion 135A can be moved to the first detection position, and the minute hand 13 is completely arranged at the reference position. Subsequently, the process proceeds to the second transmitted state searching Step S30.

Subsequently, similarly to the first embodiment, the second transmitted state searching Step S30 is performed. Through the above-described processes, detecting the rotation position of the second wheel & pinion 43 is completed, and the second hand 14 is completely arranged at the reference position. The hand position detection operation is completed.

As described above, in the present embodiment, the center wheel & pinion 133 has the three center wheel transmittable portions 135 disposed in parallel at the unequal interval which is the multiple of 360°/(M×N). Even in this case, the angular interval of the center wheel transmittable portions 135 adjacent to each other in the circumferential direction of the center axle O is set to the multiple of 360°/(M×N). In this manner, the respective center wheel transmittable portions 135 and the minute detection wheel transmittable portion 37 can be concurrently located at the first detection position. Accordingly, the minute detection wheel transmittable portion 37 enables the first light receiving element 64 to be shifted between a state where the light emitted from the first light emitting element 61 can be detected and a state where the light cannot be detected, and it is possible to reliably detect the rotation position of the center wheel & pinion 133.

In addition, in the present embodiment, the maximum central angle θ1 in the central angle formed by the center wheel transmittable portions 135 adjacent to each other in the circumferential direction of the center axle O is set to 180°. Accordingly, compared to the configuration according to the first embodiment in which the maximum central angle θ in the central angle formed by a pair of the center wheel transmittable portions 35 is set to 240°, it is possible to minimize the rotation amount of the center wheel & pinion 133 when the rotation position of the center wheel & pinion 133 is determined. Therefore, it is possible to shorten time for operating the first light emitting element 61, and thus, it is possible to reduce power consumption when the hand position is detected.

The invention is not limited to the embodiment described above with reference to the drawings, and various modification examples are conceivable within the technical scope of the invention.

For example, in the above-described respective embodiments, the minute detection wheel 34 has one (N=1) minute detection wheel transmittable portions 37, but the configuration is not limited thereto.

Figure 20:
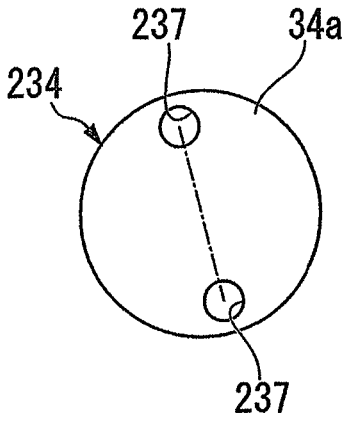
FIG. 20 is a plan view illustrating a modification example of the minute detection wheel.

FIG. 20 is a plan view illustrating a modification example of a minute detection wheel.

As illustrated in FIG. 20, a minute detection wheel 234 has two (N=2) minute detection wheel transmittable portions 237 which are disposed on the same rotation trajectory. The respective minute detection wheel transmittable portions 237 are disposed at an interval of 180° (360°/N) in the circumferential direction of the minute detection wheel 234.

As described above, even in a case where two or more minute detection wheel transmittable portions 237 are disposed, the angular interval of the center wheel transmittable portions 35 and 135 adjacent to each other in the circumferential direction of the center axle O is set to the multiple of 360°/(M×N). In this manner, the respective center wheel transmittable portions 35 and 135 and the minute detection wheel transmittable portion 237 can be concurrently located at the first detection position.

Three or more minute detection wheel transmittable portions may be disposed.

In addition, in the above-described respective embodiments, each transmittable portion disposed in each gear body is disposed by forming the through-hole in the gear body, but the configuration is not limited thereto. For example, each transmittable portion may be disposed in such a way that each gear body is formed using a light-transmitting member and other regions except for each transmittable portion are coated with a light-blocking coating material.

In addition, the end portion of the first second wheel transmittable portion may have an arcuate shape instead of a rectangular shape. In this case, the end portion has a shape in accordance with an emitting shape of the light emitted from the light emitting element. Therefore, the end portion of the long hole can also reliably detect whether or not the light is received.

In addition, in the above-described embodiment, the gear ratio of the center wheels & pinions 33 and 133 with respect to the minute detection wheel 34 is set to 1/30, but the configuration is not limited thereto. The gear ratio of the center wheel & pinion with respect to the minute detection wheel may be set to 1/M (M is an integer).

In addition, in arranging the train wheel according to the above-described embodiments, a configuration is adopted in which the second train wheel 40 has the second stepping motor 22, the second wheel & pinion 43 (second gear) for driving the second hand 14, and the sixth wheel 41 and the fifth wheel 42 which transmit the power of the second stepping motor 22 to the second wheel & pinion 43. According to this configuration, it is assumed that the hand operation of the second hand 14 employs a less variable multi-hertz (Hz) hand operation (driving method of using multiple pulses per second, since the rotation angle of the rotor per pulse for driving the stepping motor 22 is small). However, it is also possible to employ a normal hand operation (driving method of using one pulse per second). In this case, it is possible to omit the sixth wheel 41. That is, the invention is applicable to a timepiece which employs the multi-hertz hand operation and the normal hand operation by optionally configuring the second train wheel 40.

Alternatively, within the scope not departing from the gist of the invention, configuration elements in the above-described embodiments can be appropriately replaced with known configuration elements.

What is claimed is:

1. A movement comprising:

a first gear that is rotated by power of a first drive source so as to drive a first indicating hand;

a position detecting gear that is rotated by the power of the first drive source, and in which a gear ratio of the first gear with respect to the position detecting gear is set to 1/M by using M as an integer;

a light emitting element that is arranged on one side in an axial direction of a center axle of the first gear, with respect to the first gear and the position detecting gear; and a light receiving element that is arranged on the other side in the axial direction across the first gear and the position detecting gear, and that detects light emitted from the light emitting element, wherein the first gear has multiple first transmittable portions which are disposed on the same rotation trajectory, and through which the light emitted from the light emitting element is transmittable, wherein the position detecting gear has the N-number of second transmittable portions which are disposed on the same rotation trajectory, and through which the light emitted from the light emitting element is transmittable, wherein the second transmittable portions are disposed at an interval of 360°/N in a circumferential direction of the position detecting gear, wherein the multiple first transmittable portions are disposed in parallel at an unequal angular interval in the circumferential direction of the center axle, and wherein an angular interval of the first transmittable portions adjacent to each other in the circumferential direction of the center axle is set to magnification of 360°/(M×N).

2. The movement according to claim 1, further comprising:

a second gear that is arranged coaxially with the center axle, and that is rotated by power of a second drive source so as to drive a second indicating hand; and a control unit that controls driving of the first drive source and the second drive source, and that detects the light received by the light receiving element, wherein the second gear has a third transmittable portion which is disposed on a rotation trajectory of the first transmittable portion when viewed in the axial direction, and through which the light emitted from the light emitting element is transmittable, wherein the third transmittable portion is a long hole extending in a circumferential direction of the center axle, wherein a first central angle formed by both end portions of the third transmittable portion is set to be equal to or larger than a second central angle corresponding to a portion between the end portions of the third transmittable portion corresponding to a region other than the third transmittable portion of the second gear, wherein in a central angle formed by the first transmittable portions adjacent to each other in the circumferential direction, the maximum central angle is set to θ, wherein the control unit performs:

a transmitted state determination step of determining whether or not the light receiving element receives the light emitted from the light emitting element, a rotation angle determination step of determining whether or not the rotation angle of the first gear is equal to or larger than θ, in a case where the light receiving element does not receive the light emitted from the light emitting element in the transmitted state determination step, a first drive step of performing the transmitted state determination step again by driving the first drive source and rotating the first gear, in a case where the control unit determines that the rotation angle of the first gear is smaller than θ, in the rotation angle determination step, and a second drive step of performing the transmitted state determination step again by driving the second drive source and rotating the second gear as much as a predetermined angle, in a case where the control unit determines that the rotation angle of the first gear is equal to or larger than θ, in the rotation angle determination step, and wherein the predetermined angle is equal to or larger than the second central angle, and is equal to or smaller than the first central angle.

3. The movement according to claim 2,
wherein the first indicating hand is a minute hand.

4. The movement according to claim 1,
wherein the first indicating hand is a minute hand.

5. An electronic timepiece comprising:
the movement according to claim 1; and
a solar panel that generates power to be supplied to the first drive source.

* * * * *